US008356703B2

(12) United States Patent
Vysma et al.

(10) Patent No.: US 8,356,703 B2
(45) Date of Patent: Jan. 22, 2013

(54) DROP SAFE WITH ACCESS TO INTERIOR COMPONENTS

(75) Inventors: Ron Vysma, Indianapolis, IN (US); Donald V. Eason, Indianapolis, IN (US)

(73) Assignee: FKI Security Group, LLC, New Albany, IN (US)

( * ) Notice: Subject to any disclaimer, the term of this patent is extended or adjusted under 35 U.S.C. 154(b) by 2580 days.

(21) Appl. No.: 10/966,413

(22) Filed: Oct. 15, 2004

(65) Prior Publication Data

US 2006/0081441 A1 Apr. 20, 2006

(51) Int. Cl.
*G07F 7/04* (2006.01)

(52) U.S. Cl. ..... 194/206

(58) Field of Classification Search ..... 194/206, 194/207; 209/534
See application file for complete search history.

(56) References Cited

U.S. PATENT DOCUMENTS

| | | | | |
|---|---|---|---|---|
| 3,312,654 | A | 5/1964 | Adams | |
| 4,263,853 | A * | 4/1981 | Robertson | 105/378 |
| 4,326,620 | A * | 4/1982 | Felix et al. | 194/344 |
| 4,821,863 | A * | 4/1989 | Okada | 194/344 |
| 5,215,363 | A | 6/1993 | Warwick, III | |
| 5,386,903 | A * | 2/1995 | Rothschild et al. | 194/350 |
| 5,601,177 | A * | 2/1997 | Oden | 194/348 |
| 5,676,231 | A * | 10/1997 | Legras et al. | 194/206 |
| 5,695,038 | A | 12/1997 | Keith, III et al. | |
| 5,700,195 | A * | 12/1997 | Halic | 463/29 |
| 5,791,450 | A * | 8/1998 | Oden | 194/348 |
| 5,813,510 | A | 9/1998 | Rademacher | |
| 5,813,914 | A * | 9/1998 | McKay et al. | 463/46 |
| 5,868,236 | A * | 2/1999 | Rademacher | 194/217 |
| 5,918,720 | A | 7/1999 | Robinson et al. | |
| 5,996,888 | A | 12/1999 | Gromatzky | |
| 6,019,207 | A | 2/2000 | Cole | |
| 6,067,530 | A | 5/2000 | Brooks, Jr. et al. | |
| 6,120,201 | A * | 9/2000 | McKay et al. | 400/691 |
| 6,158,565 | A | 12/2000 | Mikami et al. | |
| 6,170,285 | B1 * | 1/2001 | Huffman et al. | 62/448 |
| 6,293,540 | B1 | 9/2001 | Kovacs | |
| 6,378,324 | B1 * | 4/2002 | Percy et al. | 62/448 |
| 6,595,606 | B1 | 7/2003 | Gunst | |
| 6,749,515 | B2 * | 6/2004 | Hedrick et al. | 463/46 |
| 2003/0064791 | A1 | 4/2003 | Hedrick et al. | |
| 2003/0140826 | A1 * | 7/2003 | Stinson | 109/24.1 |
| 2004/0069795 | A1 * | 4/2004 | Sams | 221/281 |
| 2006/0060600 | A1 * | 3/2006 | Sams | 221/197 |
| 2007/0114108 | A1 * | 5/2007 | Richards | 194/344 |

* cited by examiner

*Primary Examiner* — Jeffrey Shapiro
(74) *Attorney, Agent, or Firm* — Christie, Parker & Hale, LLP

(57) ABSTRACT

A drop safe comprising a housing, a safe door in the housing, the safe door having a slot for accepting deposits, a bill acceptor for accepting deposits through the slot, a cash cassette for storing cash received by the bill acceptor, wherein the cash cassette moves toward the safe door upon the opening of the safe door, as the safe door moves from the closed position to the open position.

16 Claims, 24 Drawing Sheets

DROP SAFE WITH ACCESS TO INTERIOR COMPONENTS

BACKGROUND

Various business establishments, such as convenience stores, gaming establishments, and the like, perform numerous business transactions involving exchange of cash on a daily basis. To reduce the threat of theft of the cash, the cash is often deposited into a safe. There are various kinds of safes. For example, some safes allow cash to be deposited directly into the safe via slots ("cash drop"); other safes accept cash which is first placed into an envelope and then the envelope is placed into the safe via slots ("envelope drop"). The cash is deposited into a safe without having to open the safe, thereby reducing the threat of theft.

There are a variety of drop safes, vending machines, and the like which accept money from a user and safely store it. Such drop safes usually include a bill reader, or a currency validator, and a container, such as a cash box or a cash cassette, which is located in the safe or the vending machine's cabinet or chassis. Some safes contain bill acceptors which deposit the money into a receptacle that may be accessed by opening the bill acceptor itself. The bill reader or bill validator checks the validity of the cash bill and counts the cash received.

Access of the various components of the drop safe is needed for removal of the cash container and servicing of the bill reader, its mechanics and the safe's electronics. One disadvantage of the currently available drop safes is that their cash container, as well as the safe electronics, are located within the safe, making access for service and removal of cash somewhat inefficient.

One solution involves mounting the cash container on wheels, slides or the like, and allowing for manual removal of the cash container after the safe is opened. One example of such a drop safe is shown in U.S. Pat. No. 5,813,510 to Rademacher. Rademacher describes a drop safe and a change making mechanism wherein the user first opens a safe door, thereby exposing the interior of the drop safe. After the door is opened, the user can then pull out a shelf mounting a coin dispensing mechanism. Once the coin dispensing mechanism is pulled out, the currency may be loaded.

As another example, U.S. Pat. No. 6,595,606 to Gunst describes a cash dispenser with roll-out drawer assembly. In Gunst, a cash drawer assembly of the cash dispenser has a frame with sliding members near the top and wheels at the front. In order to access the cash drawer assembly, the user must first open a door of the cash dispenser and then roll out the cash drawer assembly.

In solutions such as these, the user has to perform at least two steps to access the cash box, the bill validator or safe's electronic components. First, the user must open the safe door, and second, the user must manually move the cash cassette or the bill validator to a position where it can then be removed or repaired in a separate step. This at least two-step process of making various drop safe's components available for removal or maintenance is not always efficient. For example, when armored security transport needs to access the drop safe to move cash currency, it is preferable for the armored transport personnel to be able to move the cash from inside the drop safe to the transport as quickly as possible. Thus, there still exists a need for a drop safe wherein the cash cassette, the bill acceptor, and/or electronics can be more easily accessed for removal or servicing. In particular, there exists a need for a drop safe wherein various components of the drop safe, such as the cash cassette, the bill validator, etc., would become accessible for service and/or removal upon the opening of the safe door.

Another solution to the problem of easy access of safe electronics and cash cassette is provided for by a number of drop safes and vending machines where some of the safe components are mounted directly onto the door of the safe and thus pivot with the door when the door is opened. Examples of such mechanisms are shown in U.S. Pat. No. 5,386,903 to Rothschild et al., U.S. Pat. No. 6,067,530 to Brooks, Jr. et al., incorporated herein by reference, and U.S. Pat. No. 5,918,720 to Robinson et al. Robinson, for example, teaches a safe for storage of money, where money is inserted into a bill validator, which is then conveyed into partitioned compartments coupled to a safe door. The door of the safe rotates about hinges, and once opened, the partitioned compartments containing the sorted cash can be accessed. Similarly, Brooks discloses a cash management system wherein a bill validator is fixedly mounted to the inside surface of a door of an electronic safe. The user feeds bills into the bill validator from the outside surface of the safe door. Opening the safe door rotates the bill validator to a position where it can be accessed by the user.

However, such systems are limited in that the kinds and types of safe components which can be mounted on the door are restricted by the size and construction of the door. A large cash receptacle cannot be easily mounted onto a door without obstructing the opening of the door. A large cash receptacle or a bill acceptor attached to the safe door also requires a large space for pivoting of the cash box or the bill acceptor. This requirement places limits on construction of the safe. In addition, safe doors are generally heavy. Mounting of additional components on the door would make them even heavier, especially when the additional component, such as a safe box is itself heavy due to the weight of the currency being stored within. The increased weight of the door, makes opening of the door even more difficult. In addition, pulling out of the cash cassette also requires some additional maneuvering.

Various embodiments of the present invention are designed to address one or more of the discussed drawbacks.

SUMMARY

The present invention relates to a safe comprising a housing having a safe door, the safe door having a slot for accepting deposits, a bill acceptor, and a cash cassette for storing currency, wherein the cash cassette moves toward the safe door upon the opening of the safe door.

In one embodiment the drop safe includes a housing, a safe door mounted to the housing to close an opening of the housing, the safe door having a slot to accept deposits, a bill acceptor located in the housing to accept deposits through the slot and a cash cassette located in the housing to store cash received by the bill acceptor. As the safe door moves from a closed position to an open position, the cash cassette moves relative to the safe door and towards the opening of the housing. In another embodiment, the cash cassette moves outward of the housing and upward as the safe door moves from the closed position to the open position.

In another embodiment, the drop safe also includes a mounting plate attached to the housing, the mounting plate having a guide rail. A carriage assembly having a support member is moveable along the guide rail as the safe door is moved from the closed position to the open position. In this embodiment, the carriage assembly houses the cash cassette.

In another embodiment of the invention, the drop safe includes a housing and a safe door mounted to the housing to close an opening of the housing, the safe door having a slot to accept deposits. The embodiment further includes an armor plate mounted adjacent to the slot along the inside of the safe door, the armor plate having a slot aligned with the slot of the safe door.

In another embodiment of the invention, the drop safe includes a housing and a safe door mounted to the housing to close an opening of the housing, the safe door having a plurality of slots to accept deposits. Corresponding bill acceptors and cash cassettes are located in the housing to accept deposits through respective slots and to store cash. In this embodiment, as the safe door moves from a closed position to an open position, the cash cassettes move relative to the safe door and toward the opening of the housing.

DETAILED DESCRIPTION

Figure 1:
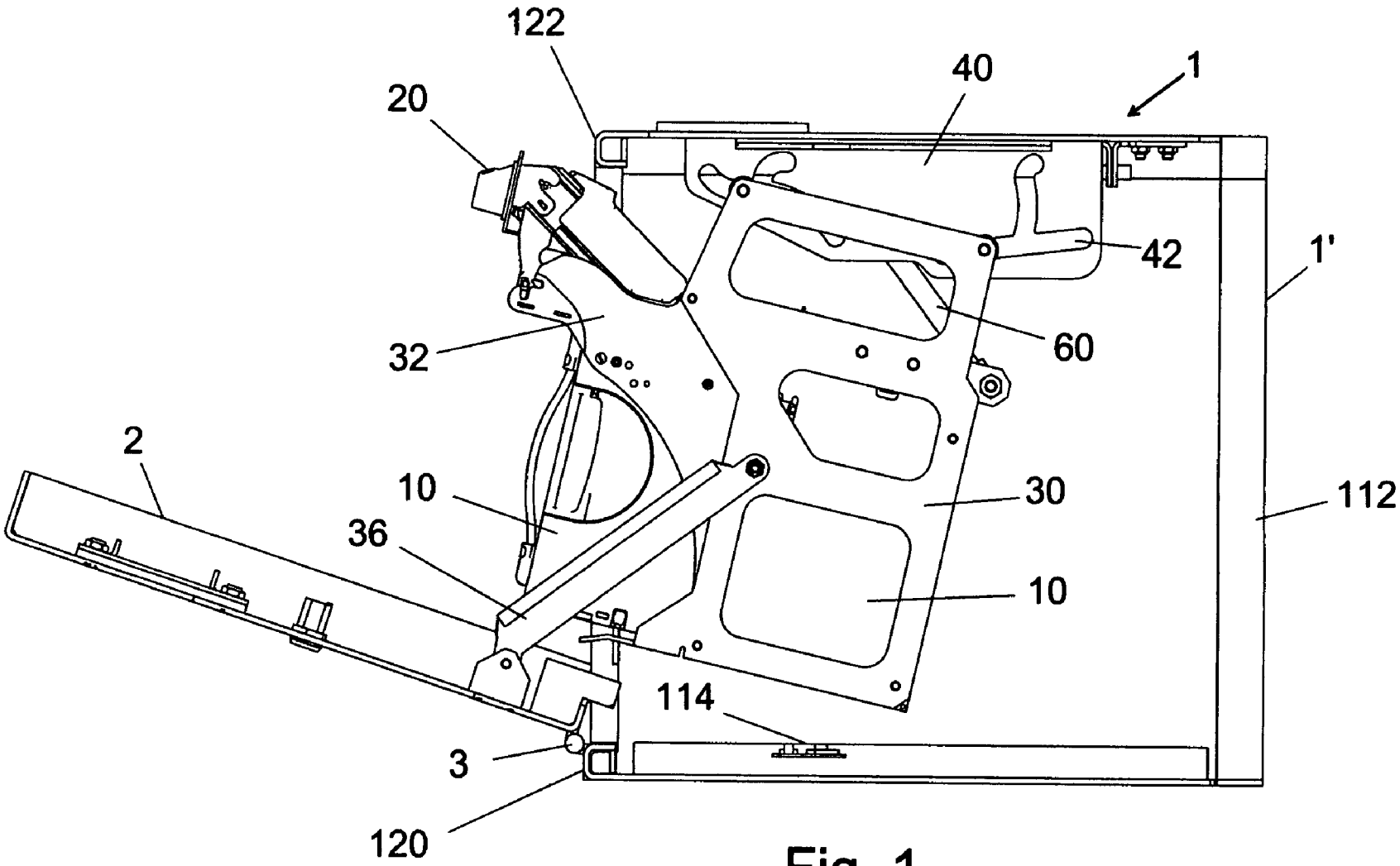
FIG. 1 is a cross-sectional side view of a drop safe according to one embodiment of the present invention.

With reference to FIG. 1, an exemplary embodiment of the present invention includes a front-loading drop safe 1 having a housing 1', a door 2, a money-storing container such as a cash cassette 10, a bill acceptor 20 (which may also be a bill reader, a bill validator, a bill reader validator, or a BRV), a carriage assembly 30 for housing at least the cash cassette 10, and a carriage rail plate 40 with guide tracks 42. These parts will now be described in more detail.

Figure 11:
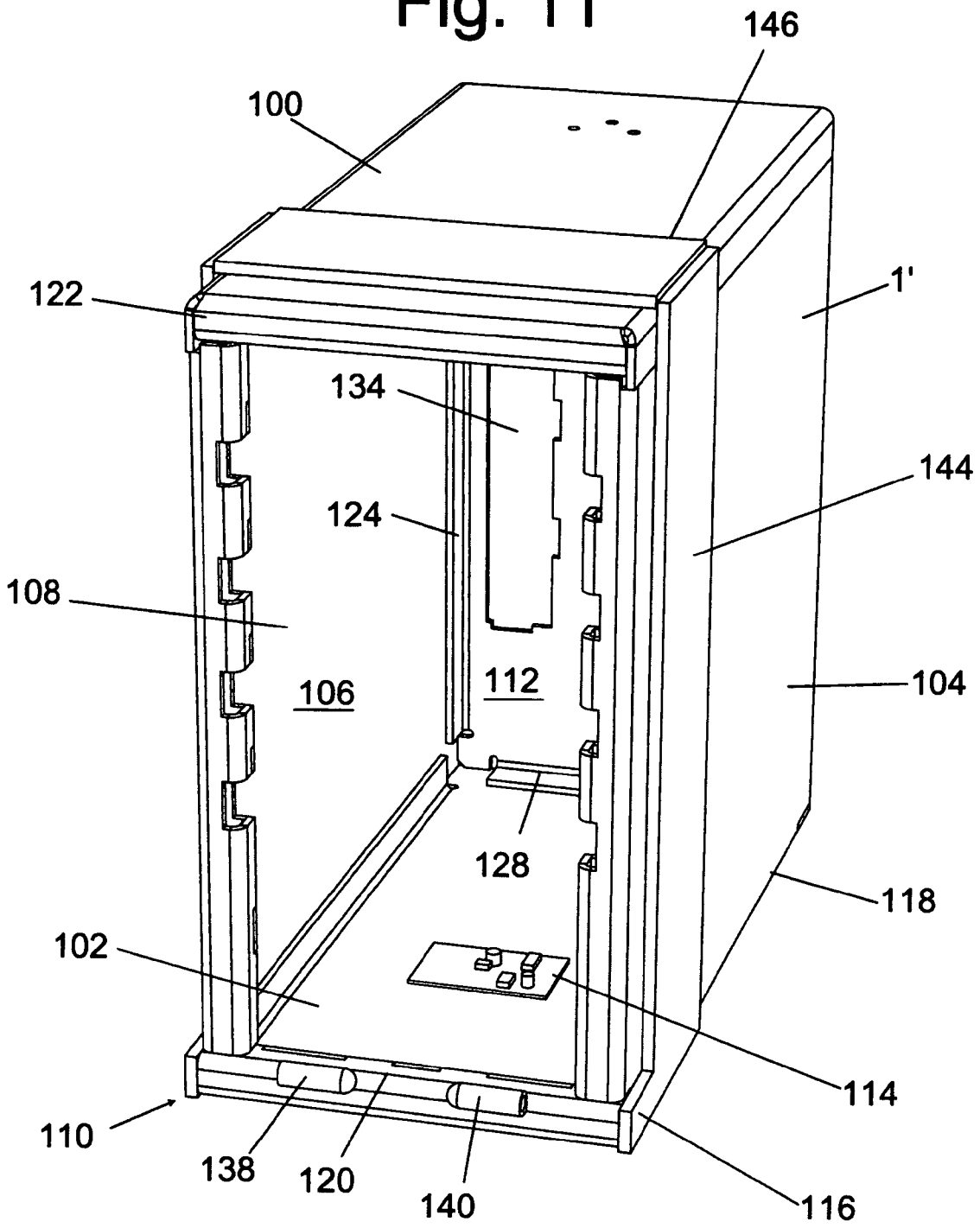
FIG. 11 shows a housing of a safe according to an exemplary embodiment of the present invention.

The housing 11 of the drop safe, shown in FIG. 11, has a top 100, a bottom 102, a back wall 112, and sides 104 (right) and 106 (left). The top 100, the bottom 102 and the sides 104, 106 form an opening 108 at a front 110 of the safe 1. The housing 1' is generally parallelepiped shape, and the back wall 112 is located opposite the opening 108.

The bottom 102 forms a generally J-shaped flange 120 (better seen in FIG. 1) at the bottom's front end 116 for added structural strength and security against break-ins. The flange 120 extends upward toward the top 100 and rearward toward the back wall 112. In this way, the open end of the "J" shape faces the back wall 112 of the housing 1'.

The top 100, likewise, has a generally J-shaped flange 122, where the open end of the "J" faces the back wall 112 of the housing 1'. The flange extends downward and rearward from the top 100 of the safe 1, and also provides added structural strength and security to the drop safe 1.

Figure 4:
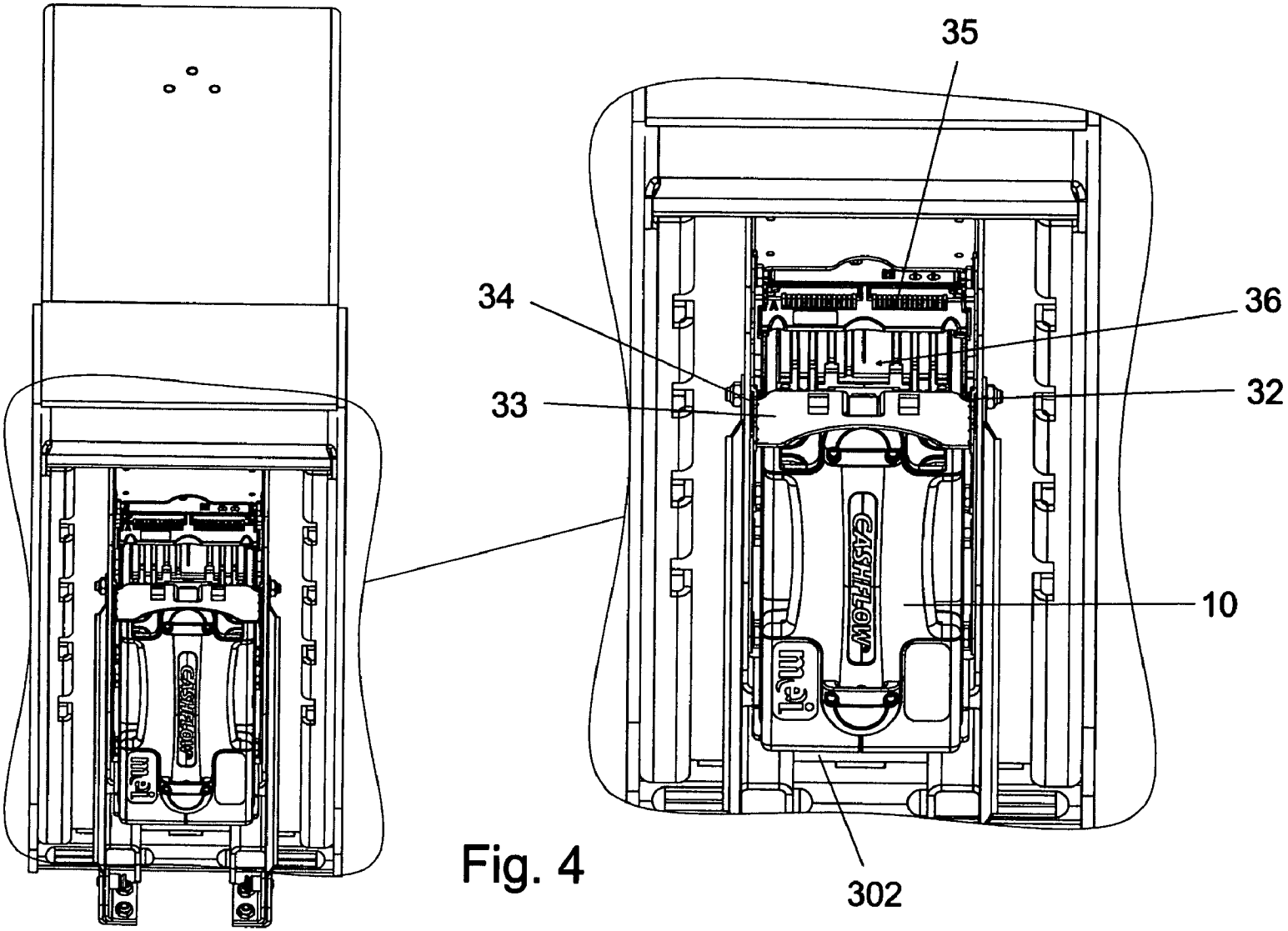
FIG. 4 is an elevated front view of a drop safe and bill acceptor mounting, with a bill acceptor removed, according to one embodiment of the present invention.

Continuing to refer to FIG. 1, the safe housing 1' also contains RFID (radio frequency identification) electronics 114 mounted to its bottom 102 near the front 110 and aligned under the cash cassette 10, for transmitting data to the cash cassette 10 and/or the bill acceptor 20. Information pertaining to deposited money (such as the time, the amount, the currency, etc.) is transmitted to a controller (not shown) from electronics 35 (FIG. 4). The controller tabulates this information and communicates with the RFID electronics 114, which, in turn, communicate with reciprocal electronics on the cash cassette 10. The RFID electronics 114 are located so as to enable optimal data transfer.

The back wall 112 of the safe housing 1' is a plate which has two brackets 124 on its sides and two brackets 128 on the top and bottom. To assemble the safe housing 1', the brackets 124 are mounted to the inner surfaces of the sides 106 and 104, and the top and bottom brackets 128 are mounted to the inner side of the top 100 and the bottom 102, respectively. The brackets 124 and 128 may be mounted to their respective parts of the housing 1' by welding, for example.

The back wall 112 of the safe housing 1' has a hole 134 for receiving various components of the safe and making the components of the safe near the back accessible. Vertically, the hole 134 spans about half the height of the housing 1', and horizontally the hole 134 is located closer to the side 106 than the side 104. The hole 134 provides an access interface for power input and machine communications with other system components i.e. printers, display devices, other validator or rolled coin dispenser machines, for example. In the shown embodiment, the sides 106 and 104 have teeth or groves at the front 110 end for enabling engagement with a locking mechanism (not shown). However, it will be appreciated by those skilled in the art that the safe 1 may be locked by any conventional means known in the art.

Continuing to refer to FIG. 11, a housing armor plate 144 is provided around the front part of the housing 1' for added security. The housing armor plate 144 is a rectangular three-piece strip of armor, such as, for example, laminated steel, which is fixedly mounted onto the housing 1' so that it wraps around the side 106, the top 100, and the side 104. The housing armor plate 144 spans approximately a third to a fourth of the length of the safe 1. That is, when the safe door 2 is closed, the housing armor plate 144 extends from the point where the door 2 meets the housing 1' to a point 146 approximately a third to a fourth of the distance between the front 110 and the back wall 112. In an embodiment of the preferred invention, the drop safe 1, being a front-loading drop safe, is located under a counter, so that the parts of the housing 1' not covered by the housing armor plate 144 are located under a counter and are not as vulnerable to an intruder attack.

Figure 2:
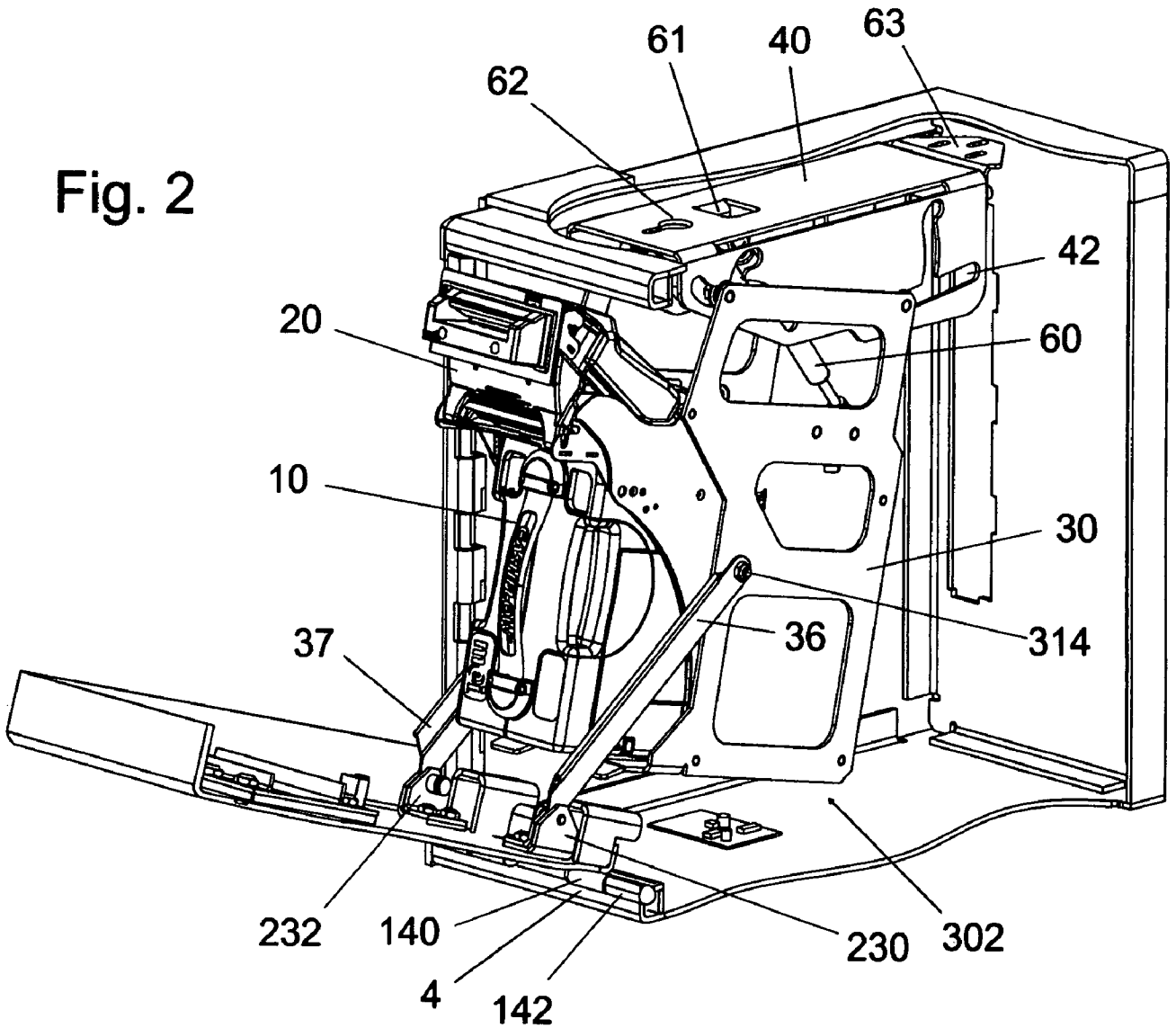
FIG. 2 is an elevated cross-sectional front view of a drop safe according to one embodiment of the present invention.
Figure 12A:
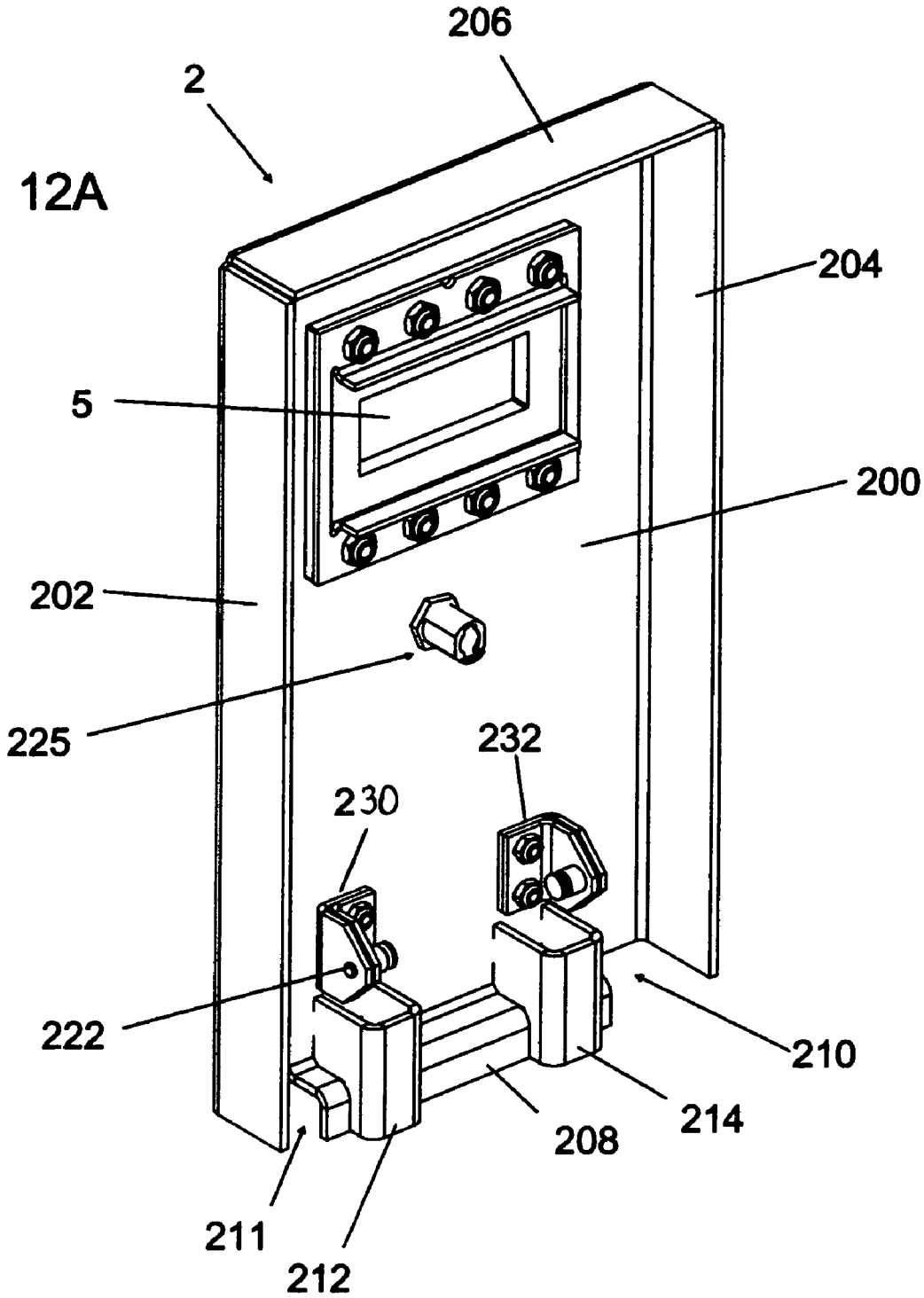
FIG. 12A shows a safe door according to an exemplary embodiment of the present invention.

Referring now to FIG. 12A, the shape of the door 2 resembles a box lid. The door 2 is made of a tamper resistant material generally known in the art, such as steel for example. It has a generally rectangular face 200 and four flanges 202, 204, 206, and 208 located at all four sides at approximately right angles to the face 200. The side flanges 202 and 204 span the entire length of the door 2. The top flange 206 spans the entire width of the door 2. The bottom flange of the door 208, however, is shorter than the width of the door 2. The bottom flange 208 is centered on the bottom side of the door 2, so that two gaps 210 and 211 are formed between the bottom flange 208 and the side flanges 202 and 204. Sides 104, 106 of the safe housing 1' are received in the gaps 211 and 210, respectively (see FIG. 14A). The flanges 202, 204, and 206 have the same length from the front to the back of the door 2, while the bottom flange 208 is shorter. In one embodiment of the invention, the bottom flange 208 may extend away from the face 200 and down. In another embodiment, the bottom flange 208 may be a flat flange horizontal to the face 200 of the door 2 (as shown in FIG. 2).

Further referring to the door 2 in FIG. 12A, situated on the bottom flange 208 are two hinge interface reinforcement/anti-door extraction brackets hereafter referred to as "hinge guard" brackets 212 and 214. The hinge guard brackets 212 and 214 are hollow U-shaped brackets conjoined on the bottom flange 208 and protruding over and down from it. The hinge guard brackets 212 and 214 are also made of the same tamper resistant material as the safe door 2 and are rigidly affixed by fasteners, welding or other means to the safe door 2. The hinge guard brackets 212, 214 provide strength and added stability to door hinges (discussed later) and the flange 208, providing higher protection against tampering.

Figure 12B:
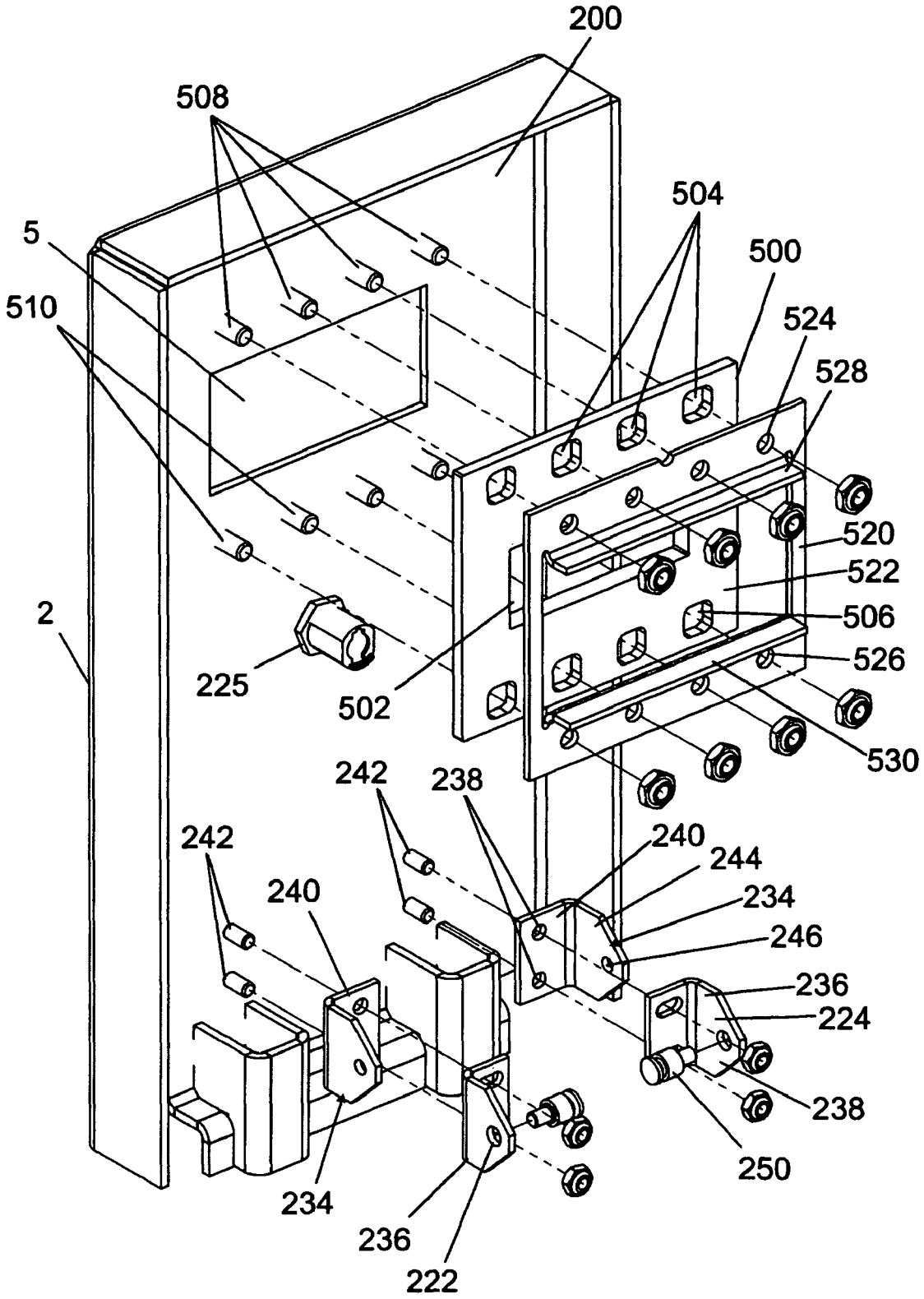
FIG. 12B is an exploded view of a safe door according to an exemplary embodiment of the present invention.

From FIG. 12A, mounted on the inner side of the face 200 of the door 2, above the two hinge guard brackets 212, 214, is a pair of door drag link brackets 230, 232. Referring to FIG. 12B, each door drag link bracket includes an outer angle bracket 234 and an inner angle bracket 236. The outer angle bracket 234 has a pair of openings 238 through a first wall 240 to permit the outer angle bracket 234 to be mounted on a respective pair of fastener supports 242 protruding from the inner face 200 of the door 2. A second wall 244 of the outer angle bracket 234 has an opening 246 for receiving a door drag link bracket bolt 250. The inner angle bracket 236 may be of a similar construction as the outer angle bracket 234 and is also mounted on the respective pair of fastener supports 238. A second wall of the outer angle bracket 234 is spaced from the first wall of the inner angle bracket to receive a respective door drag link bracket (to be described in detail below). In particular, the inner angle bracket 236 of the door drag link bracket 230 has a hole 222 for mounting a door drag link 36, and the inner angle bracket 236 of the door drag link bracket 232 has a hole 224 for mounting a door drag link 37. (see FIG. 2)

Also located on the face 200 of the door 2 is a key lock 225 (FIG. 12A). In a further embodiment, a ledge may be located below the key lock 225 on the inner surface of the face 200 of the door 2 mounted at a right angle to it. The ledge may be the same width as the top flange 206 of the door 2 and may be located parallel to it. Located in this manner, the ledge might provide additional security against a break-in.

Figure 3:
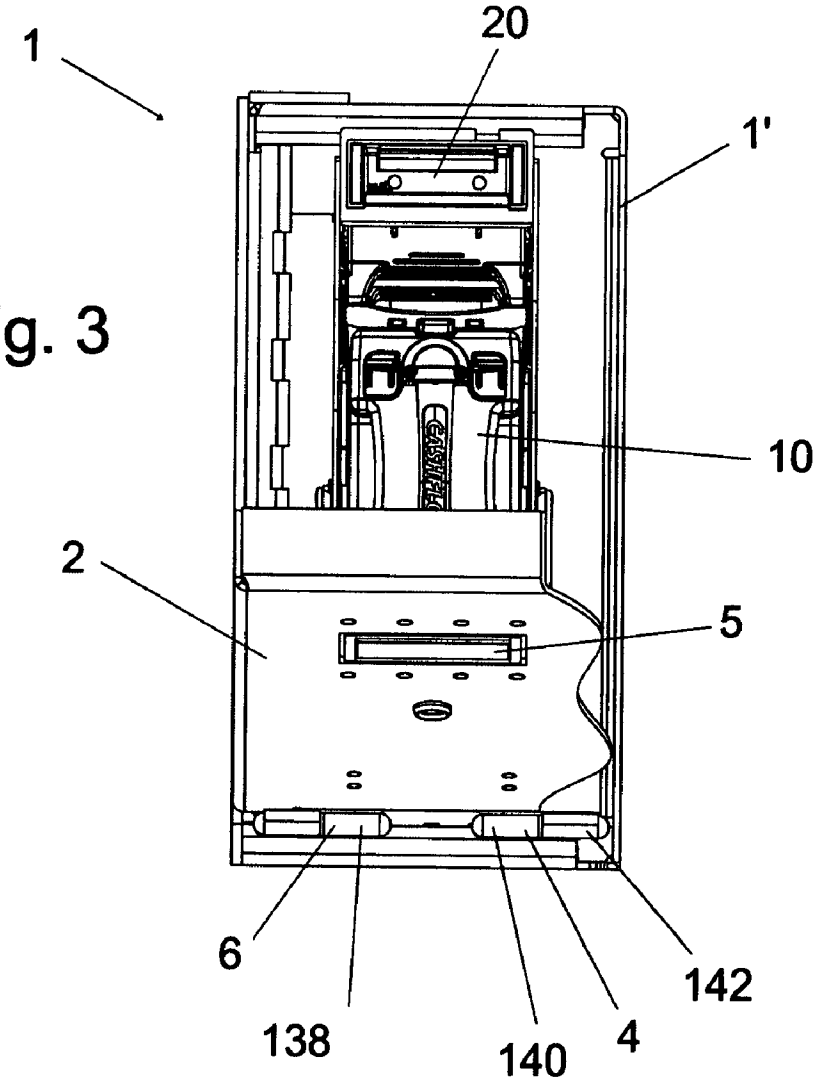
FIG. 3 is a cross-sectional front view of a drop safe according to one embodiment of the present invention.

FIG. 3 shows the door 2 having a slot 5 which receives a snout 22 of the bill acceptor 20 (seen in FIG. 5), as will be discussed below. The slot 5 is located near the top of the door 2, positioned so that the slot 5 aligns with the snout 22 of the bill validator 20 when the safe door 2 is closed.

Figure 9A:
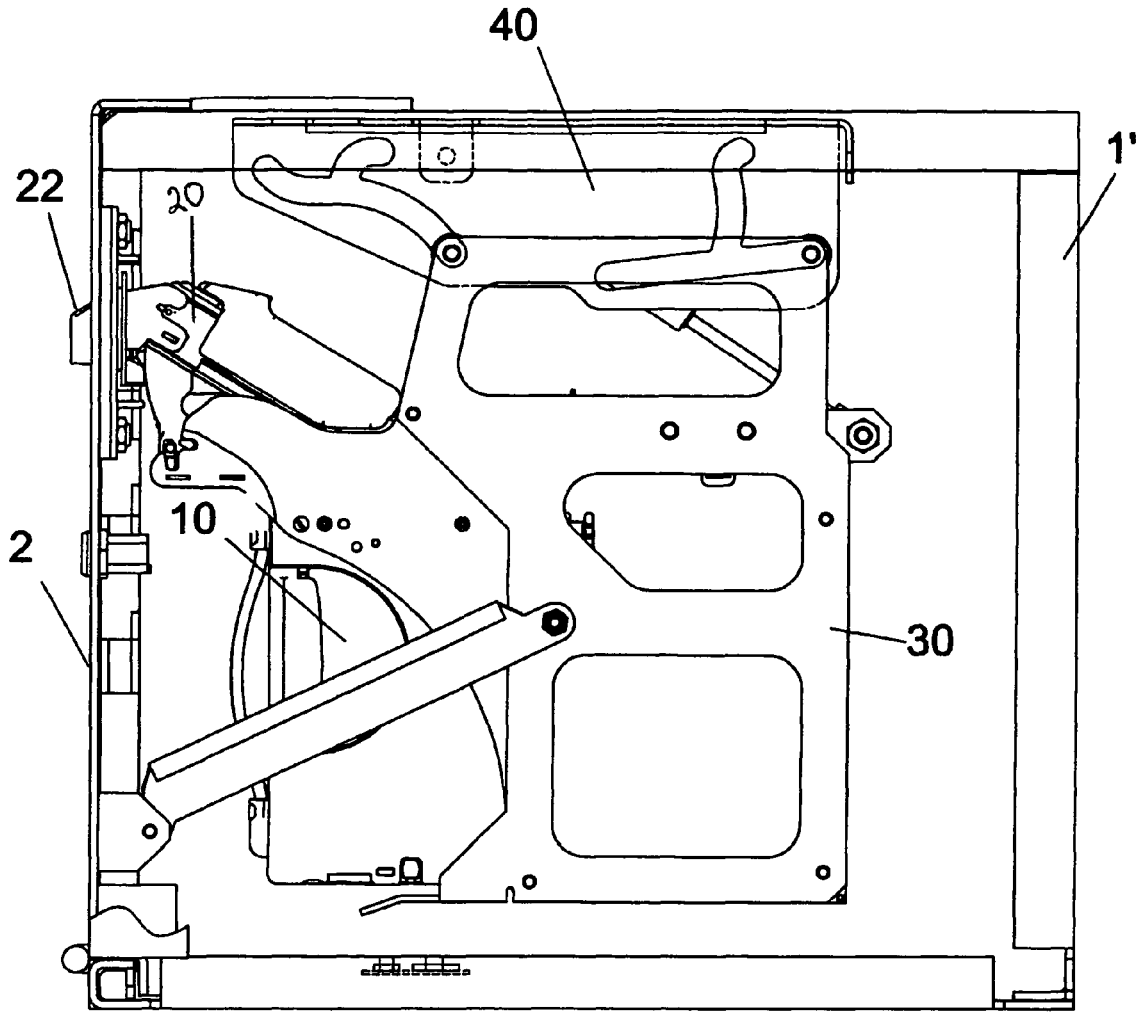
FIGS. 9A-9F are cross-sectional side views of a safe box with a carriage and guide tracks exposed as a safe door moves progressively from the closed position shown in FIG. 9A to the fully open position shown in FIG. 9F, according to a preferred embodiment of the present invention.
Figure 9B:
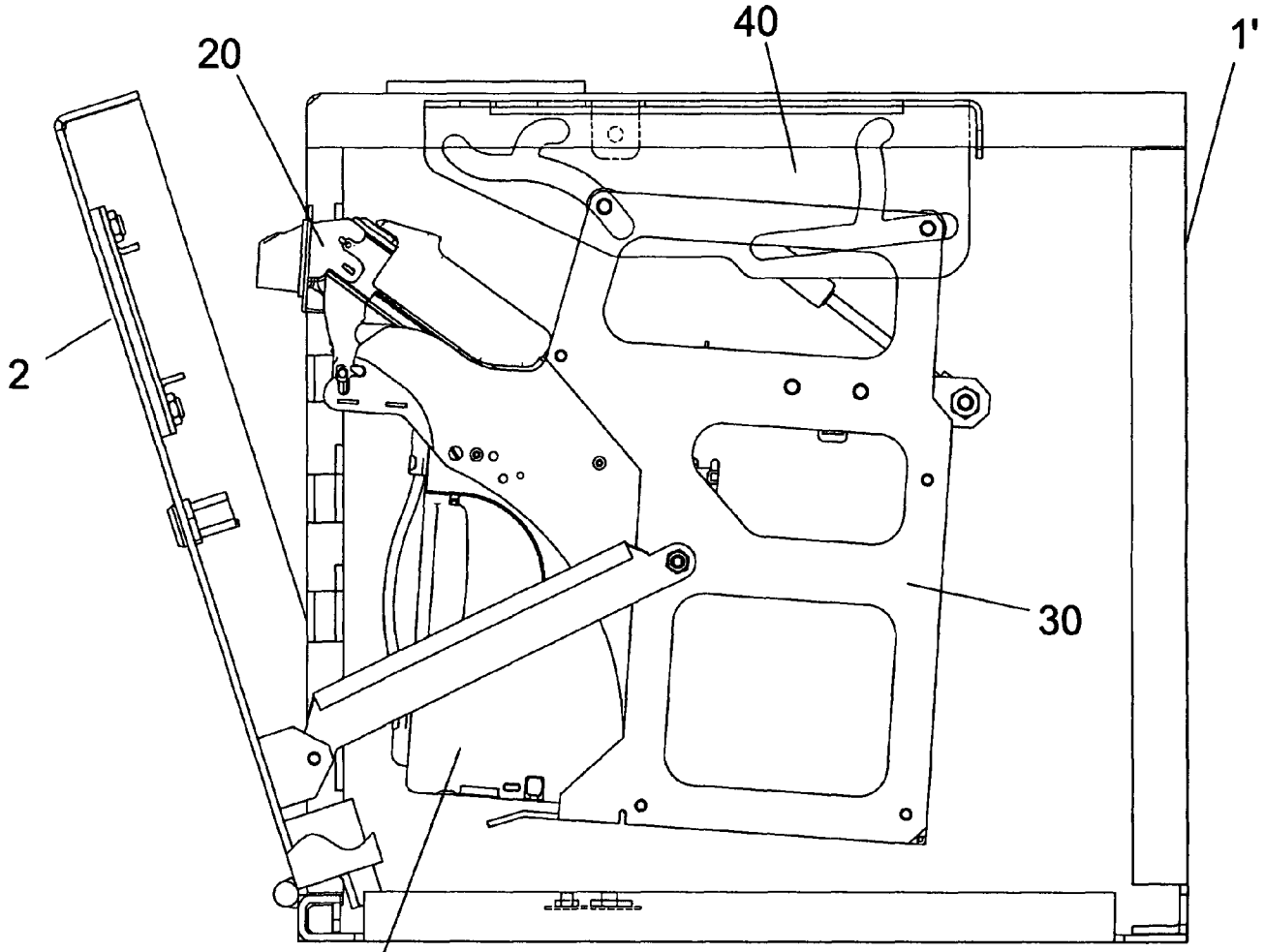
Figure 9C:
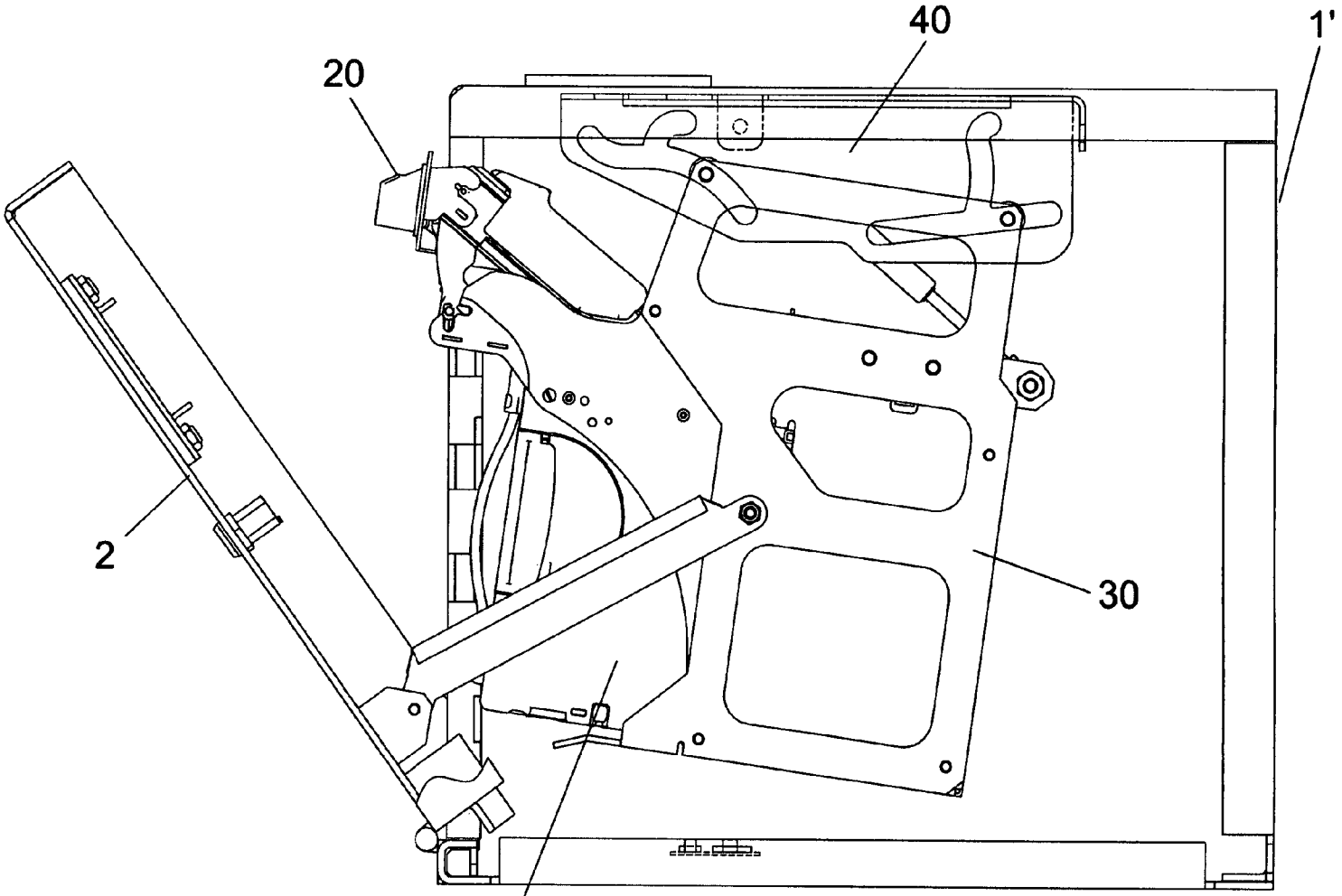
Figure 9D:
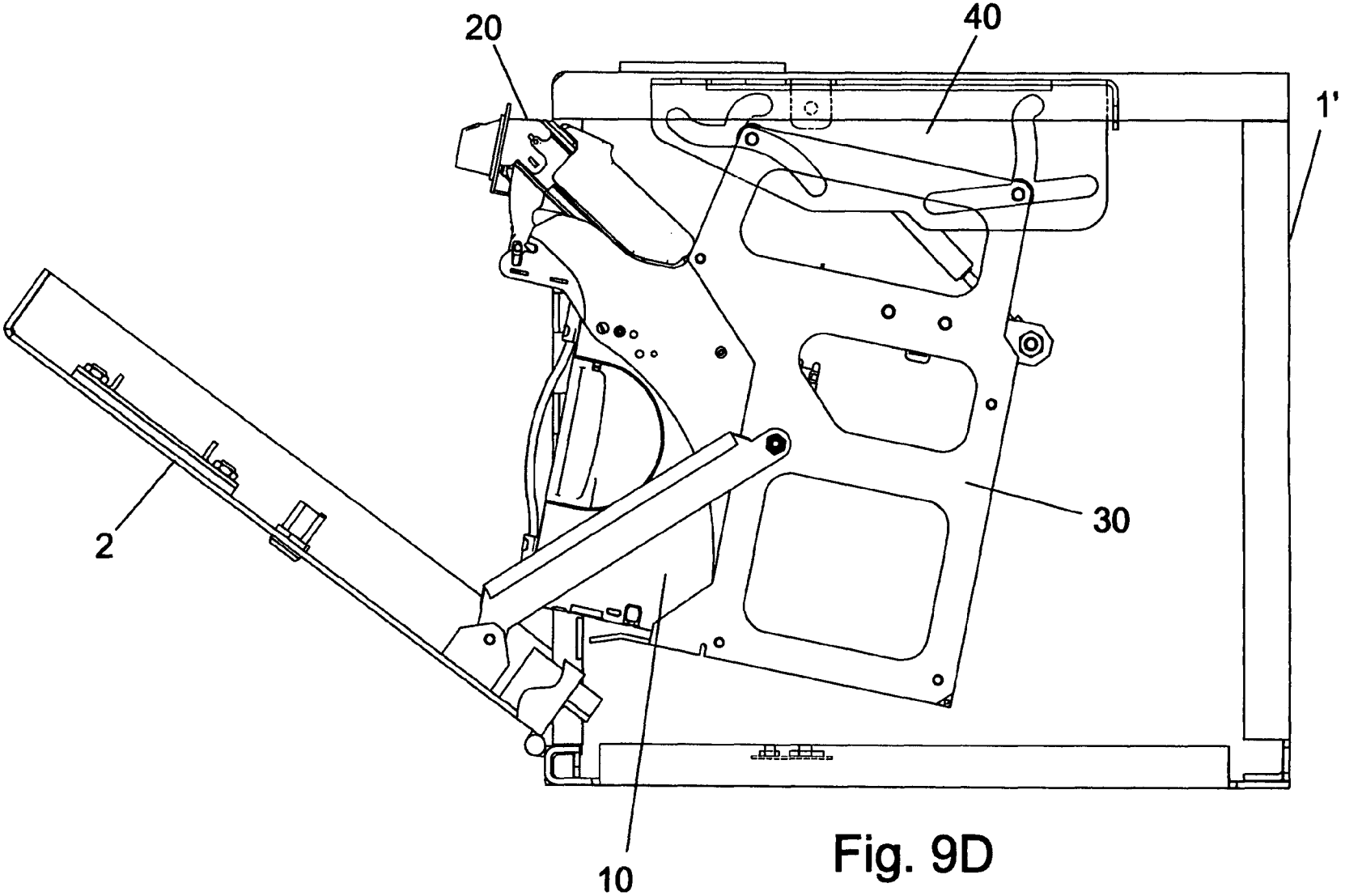
Figure 9E:
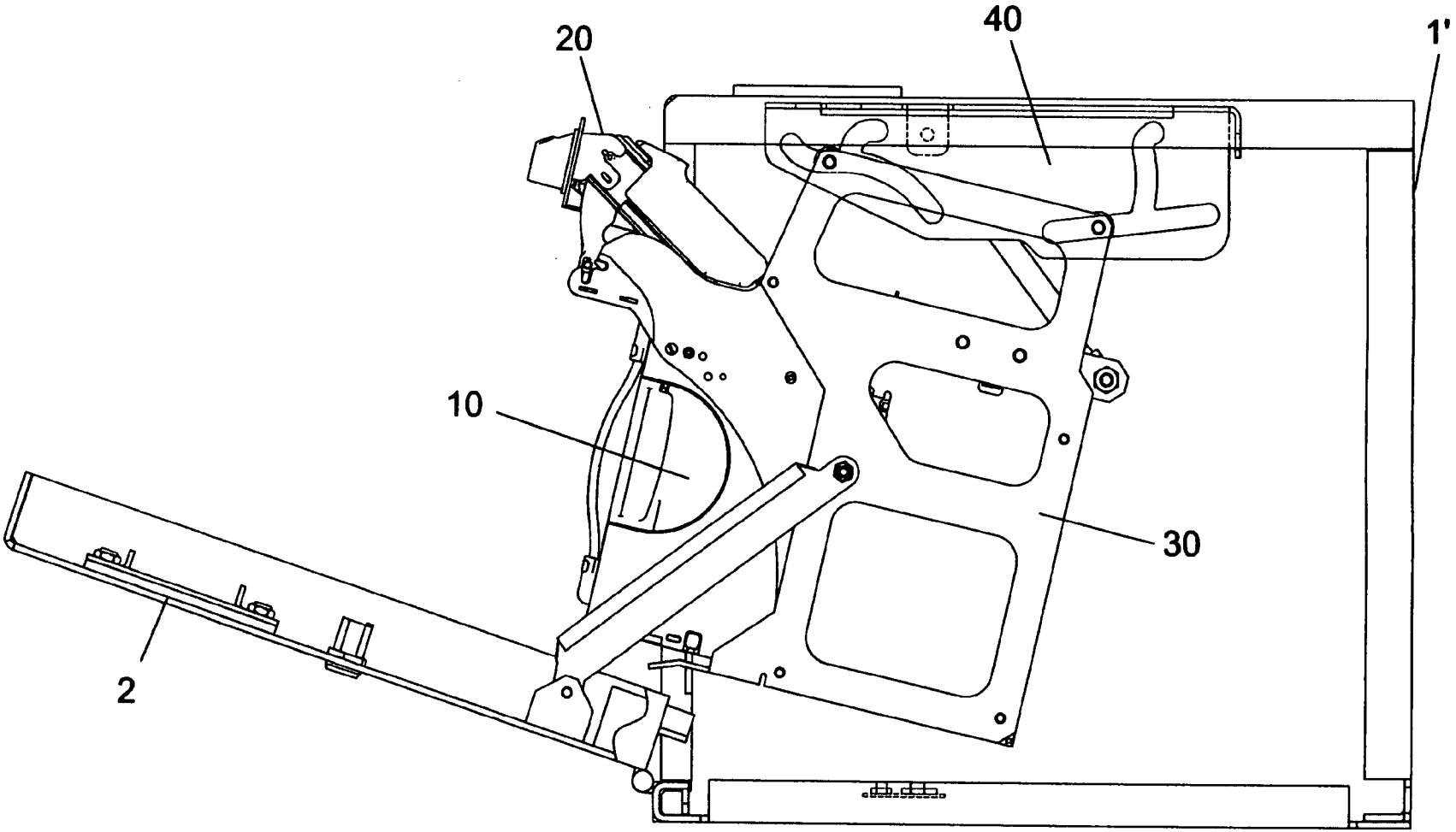

Referring to FIG. 12B, according to an exemplary embodiment of the present invention, an armor assembly comprising an armor plate 500 is provided around the slot 5. The armor plate 500 is a heat treated steel plate provided to minimize the space (or tolerance) between a snout 22 (also known as a BRV snout or a BRV bezel) of the bill acceptor 20 (show in FIG. 5) and the door 2, thereby allowing for increased security against potential break-ins at the point where the snout 22 protrudes out of the slot 5, as shown in FIG. 9A. FIG. 12B shows the mounting and assembly of the extra armor around the slot 5. Furthermore, addition of the armor plate 500 to the inner surface of the door 2 provides added strength to the area of the door around the slot 5.

The armor plate 500 is a rectangular armor plate with a rectangular armor plate opening 502 in the center. The center of the armor plate opening 502 corresponds to the center of the slot 5 in the door 2. The armor plate 500 has four openings 504 through a top and four openings 506 through a bottom side to permit the armor plate 500 to be mounted on respective top armor plate fastener supports 508 and lower armor plate fastener supports 510 protruding from the inner face 200 of the door 2.

The armor plate opening 502 may be of a different size than the door slot 5. In the exemplary embodiment of the present invention, the armor plate opening 502 is smaller than the door slot 5 to provide a tighter fit around the snout 22 (shown in FIG. 5) of the bill acceptor 20 (FIG. 5), which fits within the slot 5 and the opening 502. Thus, if the bill acceptor 20 was replaced by a different bill acceptor having a smaller snout, only the armor plate 500 need be replaced to continue providing a secure fit around the smaller snout of the new bill acceptor. Typically, replacing of the bill acceptor 20 by one with a smaller snout 22 would require replacement of the safe door 2 with a door having a smaller slot 5. However, the use of the armor plate 500 and the armor mounting around the slot 5 (shown in FIG. 12B), eliminates the need to replace the safe door. Instead, the armor plate 500 may be replaced with a new armor plate with a smaller armor plate opening, thereby minimizing the tolerance between the new snout and the door 2. In addition, the armor plate 500 may provide additional security to the safe 1 against potential tampering by providing additional armor around the slot 5 on the door 2, which is a known point of attack for intruders.

The armor assembly around the slot 5 further comprises a cover plate 520. The cover plate 520 is a rectangle with a cover plate opening 522 in the center. When the armor assembly is assembled, the center of the cover plate opening 522 corresponds to the centers of the armor plate opening 502 and the door slot 5. The size of the cover plate opening 522 may be the same or larger than the armor plate opening 502. The cover plate has four openings 524 through the top and four openings 526 through the bottom, which correspond to the openings 504, 506 of the armor plate 500, respectively. Openings 524, 526 permit mounting of the cover plate 520 to the inner face 200 of the door 2 via fastener supports 508, 510. The fastener supports 508, 510, are first fitted through the openings 504, 506 and then are fitted through the openings 524, 526, respectively, thereby mounting the cover plate 520 to the door 2, and securing the armor plate 500 sandwiched between the cover plate 520 and the door 2.

The cover plate 520 also has an upper cover flange 528 and a lower cover flange 530 which extend in the direction away from the inner face 200 of the door 2, at right angles to the cover plate 520. The top and bottom cover flanges 528, 530 are located at the top and bottom sides of the cover plate opening 522, respectively. When the snout 22 of the bill acceptor 20 is fitted through the cover plate opening 522, the armor plate opening 502, and the slot 5 of the door 2, the cover flanges 528, 530 are juxtaposed to the bill acceptor 20. In a further embodiment, the flanges 528, 530 may actually contact the bill acceptor 20. This positioning of the flanges 528, 530 provides further security in that it reduces the possibility of a break-in by prodding or prying an object into the space around the snout 22 of the bill acceptor 20.

Figure 13:
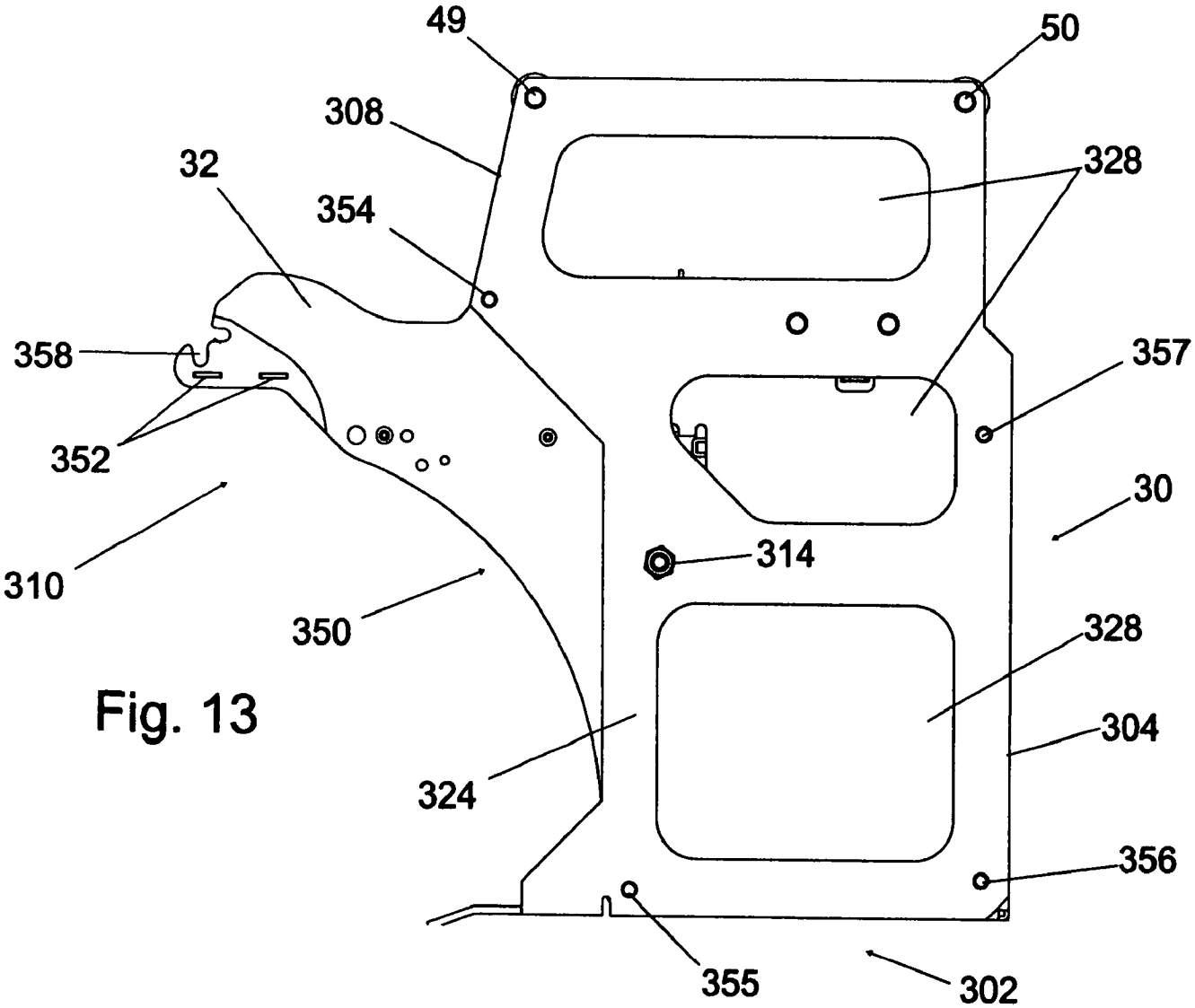
FIG. 13 is a side view of a carriage according to an exemplary embodiment of the present invention.
Figure 14A:
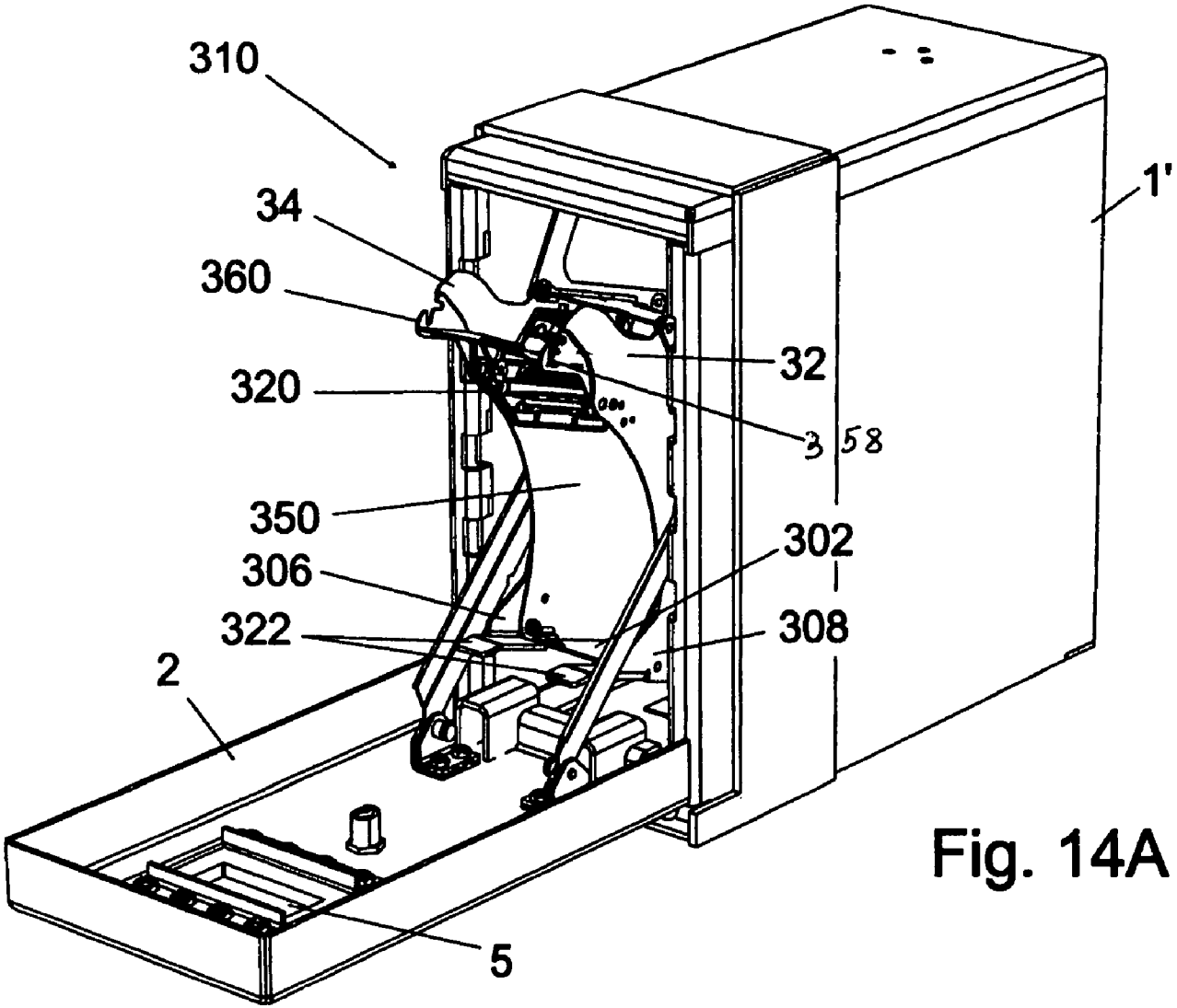
FIGS. 14A and 14B are side-front views of a drop safe, according to an embodiment of the present invention, with a cash cassette and a bill acceptor removed.
Figure 14B:
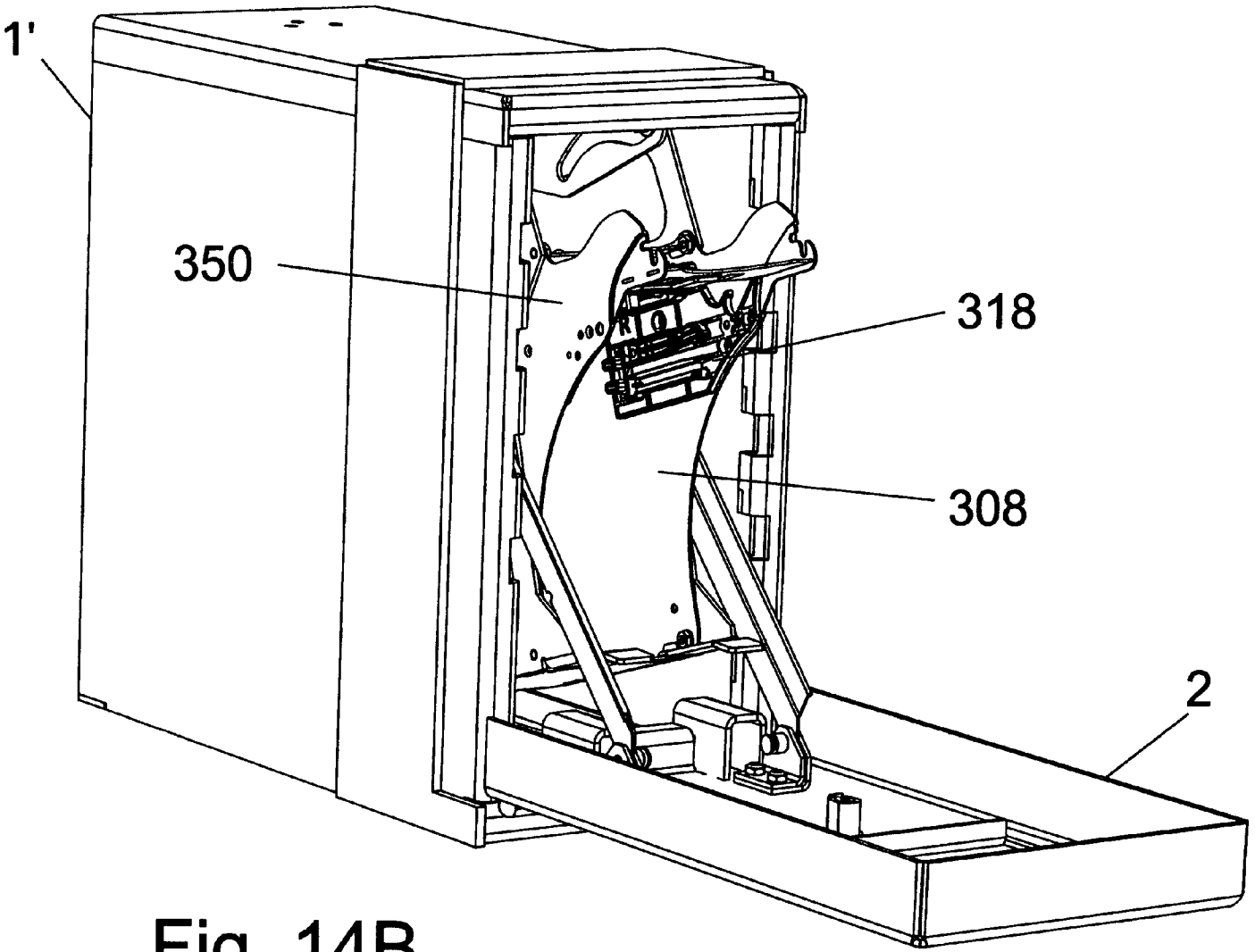

Referring now to FIGS. 14A and 14B, the carriage assembly 30 is generally parallelepiped having a floor 302, a left side 306, and a right side 308 (FIG. 14A). The carriage assembly 30 is constructed of a sturdy material, such as steel for example, and is able to support at least the weight of a full cash cassette 10 and the bill acceptor 20 (FIG. 2). The carriage assembly 30 has at least one open end at the front 310 of the carriage assembly 30, such open end being opposite a back 304 of the carriage assembly 30 (shown in FIG. 13).

Referring again to FIG. 14A, in an embodiment of the present invention, the floor 302 of the carriage assembly 30 nearest the front 310 of the carriage assembly 30 contains two flanges 322, near the sides of the outer edge of the floor 302, extending outward and down. The flanges 322 allow for easy placement of the cash cassette 10 into the carriage assembly 30. In yet another embodiment, the front of the floor 302 may be bent downward, at an angle to the floor 302 of the carriage assembly 30. In a further embodiment, the floor 302 of the carriage assembly 30 may be a rectangle, without a bent flange.

In the exemplary embodiment of the invention shown in FIGS. 13 and 14A, the sides 306 and 308 of the carriage assembly 30 have straight horizontal top and bottom edges, one mostly vertical side edge, and another side angled so as to accommodate extending arms 34 or 32 (depending on the side) of a bill reader chassis, which will be discussed in more detail later. More particularly, the sides 306, 308 of the carriage assembly 30 extend vertically. Each side includes a main wall portion 324, having three openings 238 to reduce the weight of the carriage assembly and/or to reduce the amount of steel or other material needed for construction, without compromising structural integrity. In an alternative embodiment, the sides 306 and 308 may be made of a solid piece of steel, or other material, and may contain no sizeable openings. A pair of bolt openings 314 and 316 (show in FIGS. 2, 6) are provided on the sides 308, 306 for mounting respective door drag links, the purpose of which will be described later. In particular, in the illustrated embodiment, the bolt opening 314 (FIG. 2) is provided for attaching a door drag link 36 and is located approximately two thirds of the way up the right side 308, near the edge closest to the front 310 of the carriage assembly 30. The bolt opening 316 (FIG. 6) is located in a similar position on the left side 306 of the carriage assembly 30 and allows attachment of a door drag link 37. It will be appreciated by those skilled in the art that the actual position of the bolt openings 314, 316 is dictated by mathematics and physics, and may depend on various parameters, such as the translation characteristics of the chassis, geometrical considerations, as well as consideration for the direction of forces i.e. the gas spring, center of gravity of the carriage assembly 30 and the bill validator chassis, the moment of the door 2, etc.

Figure 6:
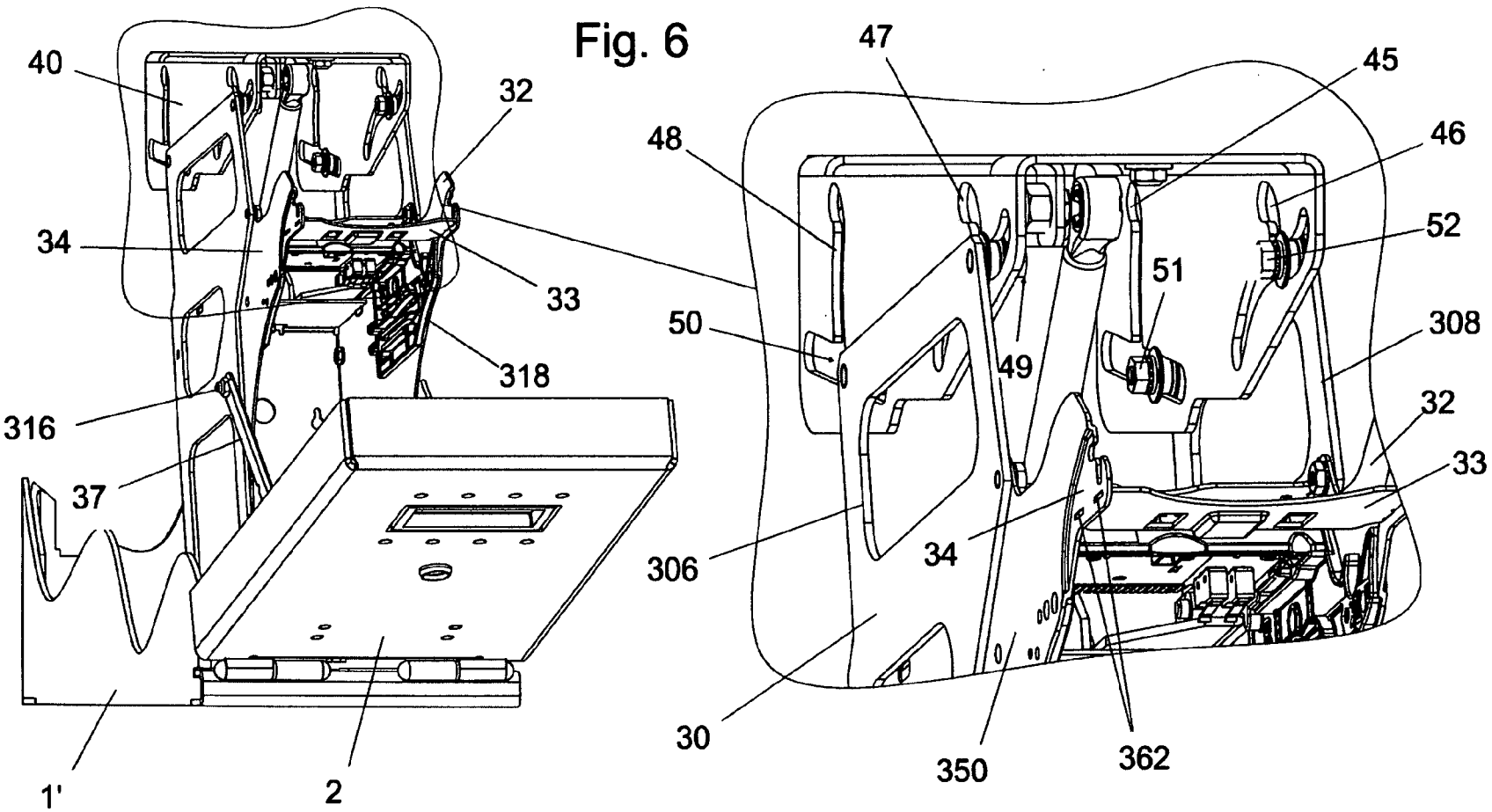
FIG. 6 is a cross-sectional front view of a carriage mounted within the guide tracks of a carriage rail plate according to an embodiment of the present invention.

Referring to FIG. 6, two support members 51 and 52 are mounted to the inner surface of the right side 308 of the carriage assembly 30 at the top rear and the top front corners, respectively. In a similar manner, two support members 50 and 49 are mounted to the inner surface of the left side 306 of the carriage 30, at the top rear and top front corners of it, respectively. The support members 49, 50, 51, and 52, for example, may be cam followers, rollers, or guide rollers, and may be attached to the carriage assembly 30 by shoulder screws on plain bearings held in place with a nut.

Figure 7A:
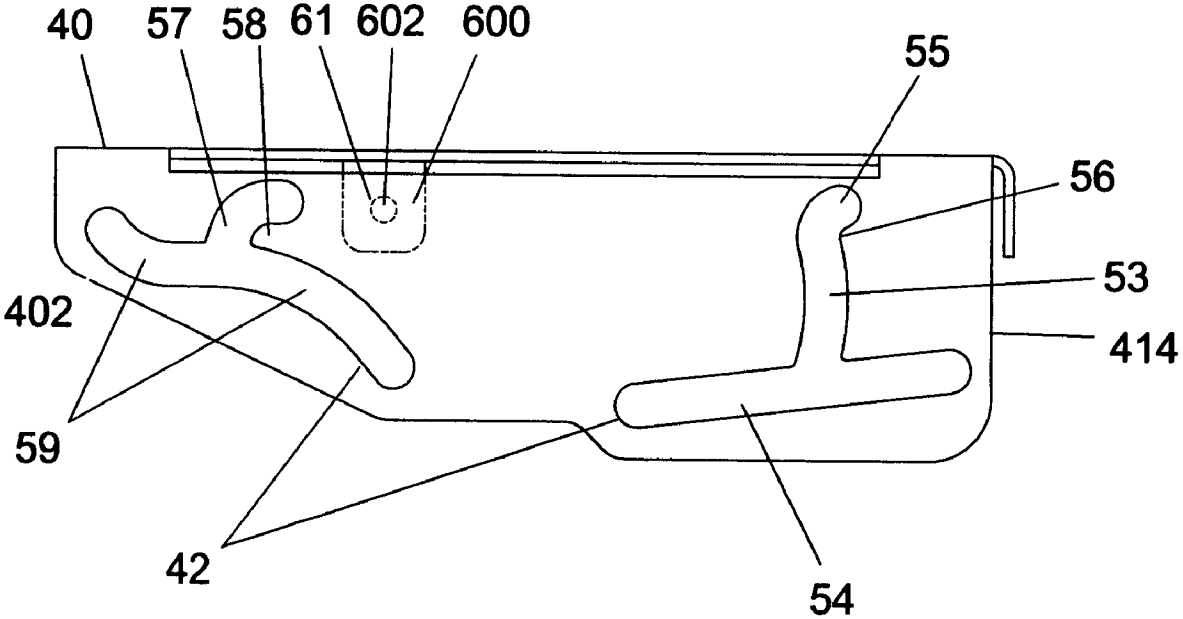
FIG. 7A is a side view of a carriage rail plate and guide tracks according to one embodiment of the present invention.
Figure 7B:
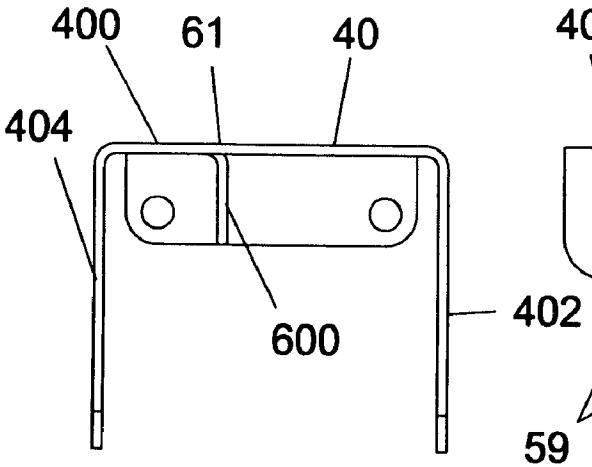
FIG. 7B is a front view of the carriage rail plate according to one embodiment of the present invention.
Figure 15A:
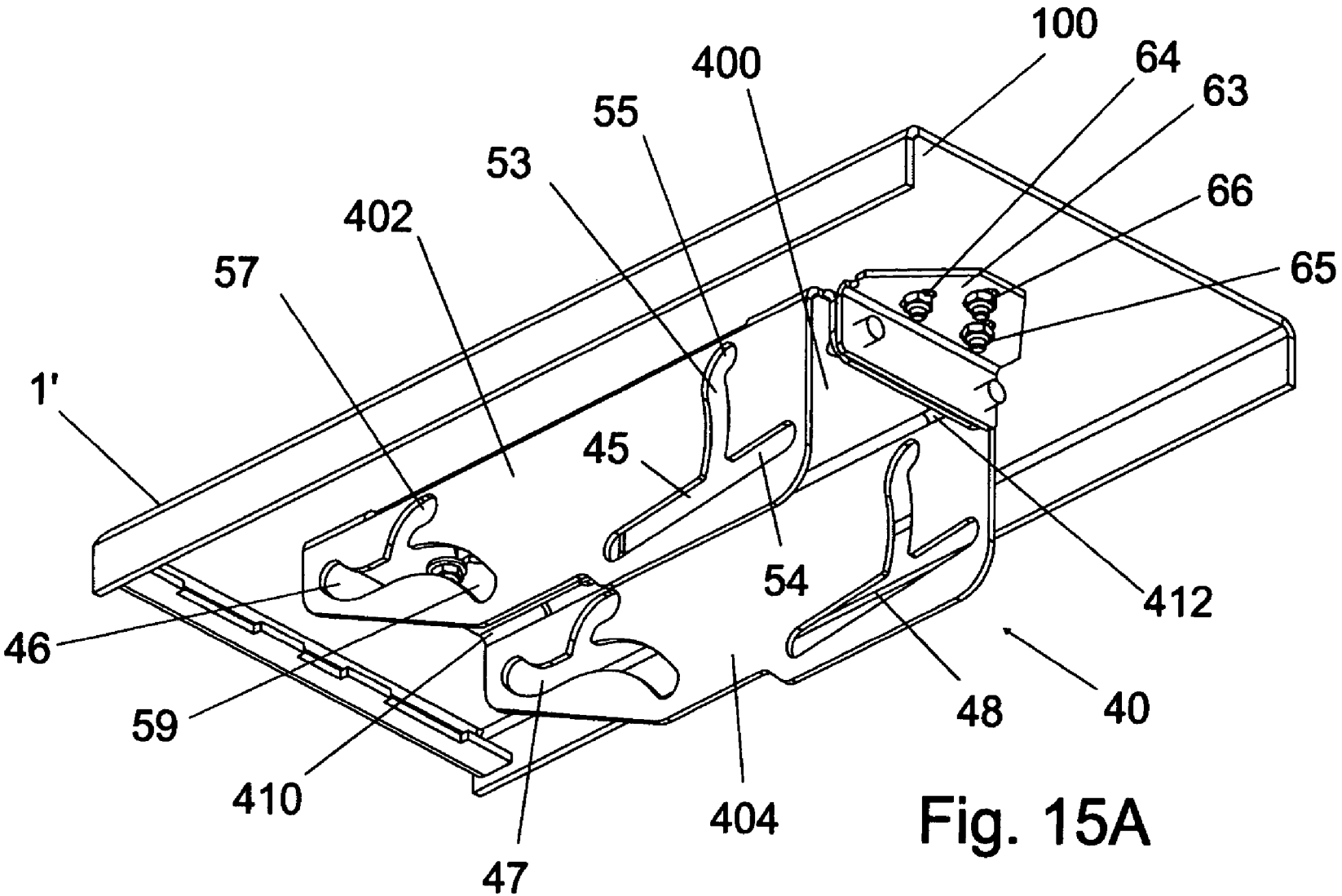
FIG. 15A is a view of a guide rail plate attached to the top of the housing according to an embodiment of the present invention.
Figure 15B:
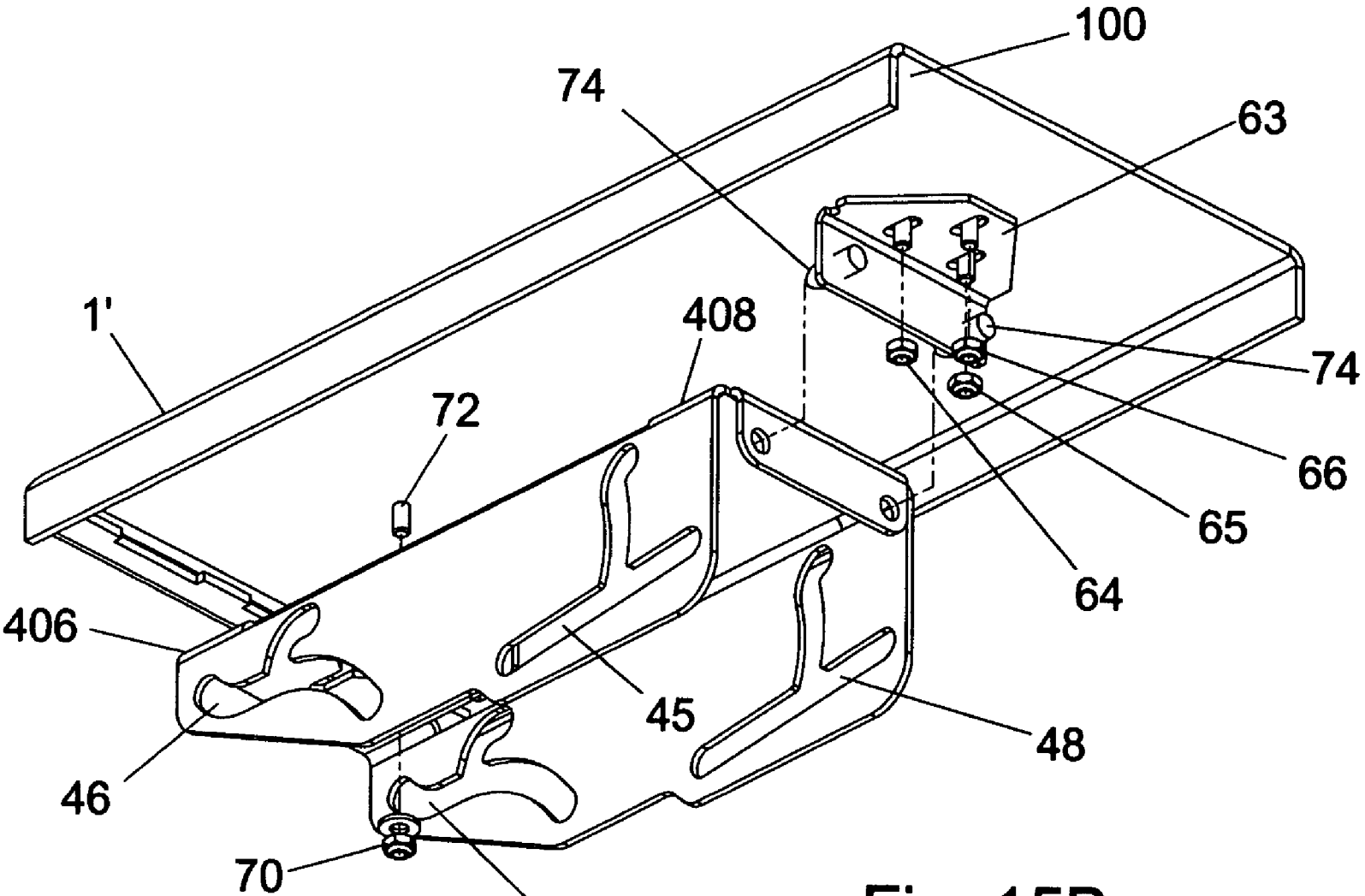
FIG. 15B is an exploded view of the guide rail plate attached to the top of the housing according to an embodiment of the present invention.

Referring now to FIGS. 15A-B and 7B, according to the preferred embodiment of the present invention, the safe 1 has a carriage rail plate 40 mounted to the top 100 inner surface of the housing 1'. The carriage rail plate 40 has a top or middle section 400 and a first side section 402 (right) and a second side section 404 (left), mounted at right angles to the middle section 400. In this respect, the two side sections 402, 404 resemble leaf sections. The first side section 402 (right side section) is mounted to the middle section 400 via two brackets 406, 408, located toward the front and the back of middle section 400 of the carriage rail plate 40, respectively. Likewise, the second side section 404 may be mounted to the main section 400 via two brackets 410, 412. In an alternative embodiment, the sides 402, 404 may be molded or welded directly to the top 400. In yet another embodiment, the sides 402, 400 and the top 400 may be made of the same sheet of metal, with the sides 402, 404 simply bent at right angles respective to the middle section 400. As can be seen in FIG. 2, the top 400 of the rail plate 40 has a key slot 62, a mounting point 61 for attaching a gas spring 60, and a bullet nose alignment bracket 63 located at the rear of the plate with three locator pins 64, 65, and 66 (shown in FIG. 15A) fixedly attaching the bullet nose alignment bracket 63 to the top 100 of the housing 1'.

Referring now to FIG. 7A, guide rail plate 40 has guide tracks (or guide rails) 42 which dictate the motion of the carriage assembly 30, as will be described below. As can be seen in FIG. 15A, the guide tracks 42 include four separate tracks: a pair of parallel aft tracks 48 and 45 and a pair of parallel front tracks 47 and 46, each one for providing support for the carriage assembly 30. The guide tracks 42 are specifically patterned to dictate the desired motion of the carriage assembly 30.

FIGS. 7A and 15A show that each of the aft tracks 45, 48 has an upper track 53 and a lower track 54. In this embodiment, the lower track 54 extends at a slight downward angle from the rear 414 toward the front of the guide rail plate 40. In an alternative embodiment, the aft tracks may incorporate an indentation which would allow maintaining the door position at a set open angle so as to prevent the door from inadvertent "self closing" potentially causing a pinch injury to the user, see, for example U.S. Patent Publication No. U.S. 2004/0040821 A1, which is incorporated herein by reference. The upper track 53 extends up from the lower track 54 at a point just beyond the middle of the lower track 54, closer to the rear 414 of the guide rail plate 40. At the top, the upper track 53 curves slightly backwards, toward the rear 414 of the guide rail plate 40, culminating with an enlarged opening 55. The lower track 54 is used to support the corresponding support member of the carriage assembly 30 while it is being moved toward the front and back. The upper track 53 is used to move the corresponding support member to the opening 55, which allows for removal of the support member there through, thereby allowing disengagement of the carriage assembly 30 from the carriage plate 40, as will be discussed below. The upper track 53 functions to allow stowage of the carriage assembly 30 and removal of the mounting plate 40 according to one embodiment of the invention.

Continuing with FIGS. 7A and 15A, each of the front tracks 46, 47 likewise has a lower track 59 and an upper track 57. The lower track 59 extends generally upwards, toward the front of the guide rail plate 40. Moving along the lower track 59 in the direction away from the rear 414 of the guide rail plate 40, the lower track 59 is first concaved downward and transitions into a curve concaved upward. The upper track 57 extends up and rearward from the lower track 59 at approximately an inflection point where the curve of the lower track 59 changes its concavity. The upper track 57 curves back somewhat behind a detent 58. It should be appreciated that any variation of the curvature of the guide tracks 42 which would move the carriage assembly 30 outward, or upward and outward, as the door 2 is being opened may be used.

Figure 16:
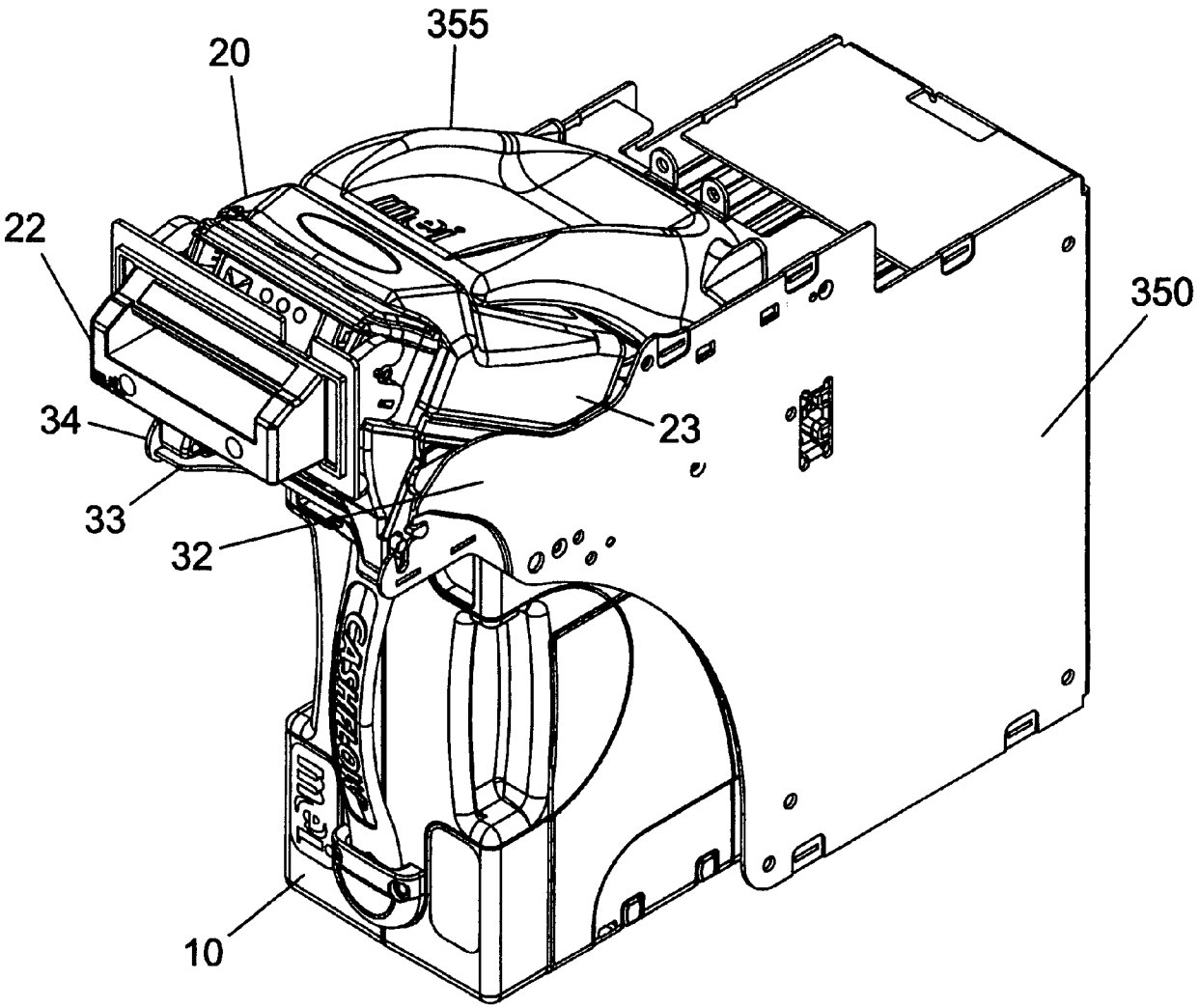
FIG. 16 shows an assembly comprising a bill acceptor, a bill reader chasse, a cash cassette and a hood.

FIG. 16 shows the cash cassette 10, the bill acceptor 20, the bill acceptor snout 22, the bill reader chassis 350, including the extending arms 32 and 34 and the plate 33. The cash cassette 10 may be any cash cassette commercially available or known in the art. For example the cassette 10 may be provided by MARS Electronics International MEI with Cashflow SCL Series_SCL 6607R, which includes a guard hood 355, the cash cassette 10, the bill acceptor 20, and bill reader chassis 350. The cash cassette 10 has a housing, a slot 36 for receiving money (shown in FIG. 4), and may have a handle for ease of removal of the cash cassette 10. In an exemplary embodiment of the present invention, the cash cassette 10 also has side guide grooves (not shown) which fit within the reciprocal guide tracks 318, 320 (FIGS. 14A-B) attached to the sides of the bill reader chassis 350, allowing the user to slide the cash cassette 10 in and out of the carriage assembly 30.

Referring to FIGS. 6, 13 and 16, the carriage assembly 30, according to the exemplary embodiment of the present invention, contains a bill reader chassis 350 for mounting the bill acceptor 20 into the carriage assembly 30. The bill reader chassis 350 includes two extending arms 32 (right) and 34 (left) and a plate 33 mounted between the two extending arms 32 and 34, fitted into the slits 352 and 362, on which the bill acceptor 20 rests. The bill reader chassis 350 is fixedly attached to the carriage assembly 30 through mounting holes 354, 355, 356, and 357 on the right side 308, shown in FIG. 13, and reciprocal mounting holes (not shown) on the left side 306 of the carriage assembly 30 via screws and bolts. The bill reader chassis 350 may be attached to the carriage assembly 30 by screws and bolts. For example, an industry standard threaded stud captive fastener, such as, for example, one sold under the mark "PEM stud" by PENN Engineering, and a typical nut may be used. Alternatively, the bill reader chassis 350 may be attached to the carriage assembly 30 by a plastic snap rivet generally known in the field which may be manually inserted through the aligned holes of the carriage assembly sides 308 and 306 and the associated mounting holes in the bill reader chassis 350.

FIG. 16 also shows a "hood" 355 for protecting a head of the bill acceptor 20 from tampering or breakage, located so that the bill acceptor 20 is placed onto the bill reader chassis 350 by being inserted between the plate 33 and the hood 355. The hood 355 minimizes the possibility that a user would open the bill reader 20 without first removing it from the carriage assembly 30 or the bill reader chassis 350.

As seen in FIGS. 14A and 14B, the bill reader chassis 350 is equipped with a pair of guide tracks for mounting the cash cassette 10. FIG. 14B shows a guide track 318 mounted to inner surface of the bill reader chassis 350 at the side right side 308 of the carriage assembly 30. A similar guide track 320, shown in FIG. 14A, is located at the left side 306 of the carriage assembly 30. The guide tracks 318 and 320 have two grooves, for guiding the cash cassette 10 into the bill reader chassis 350 and supporting the cash cassette 10 within it.

Figure 5:
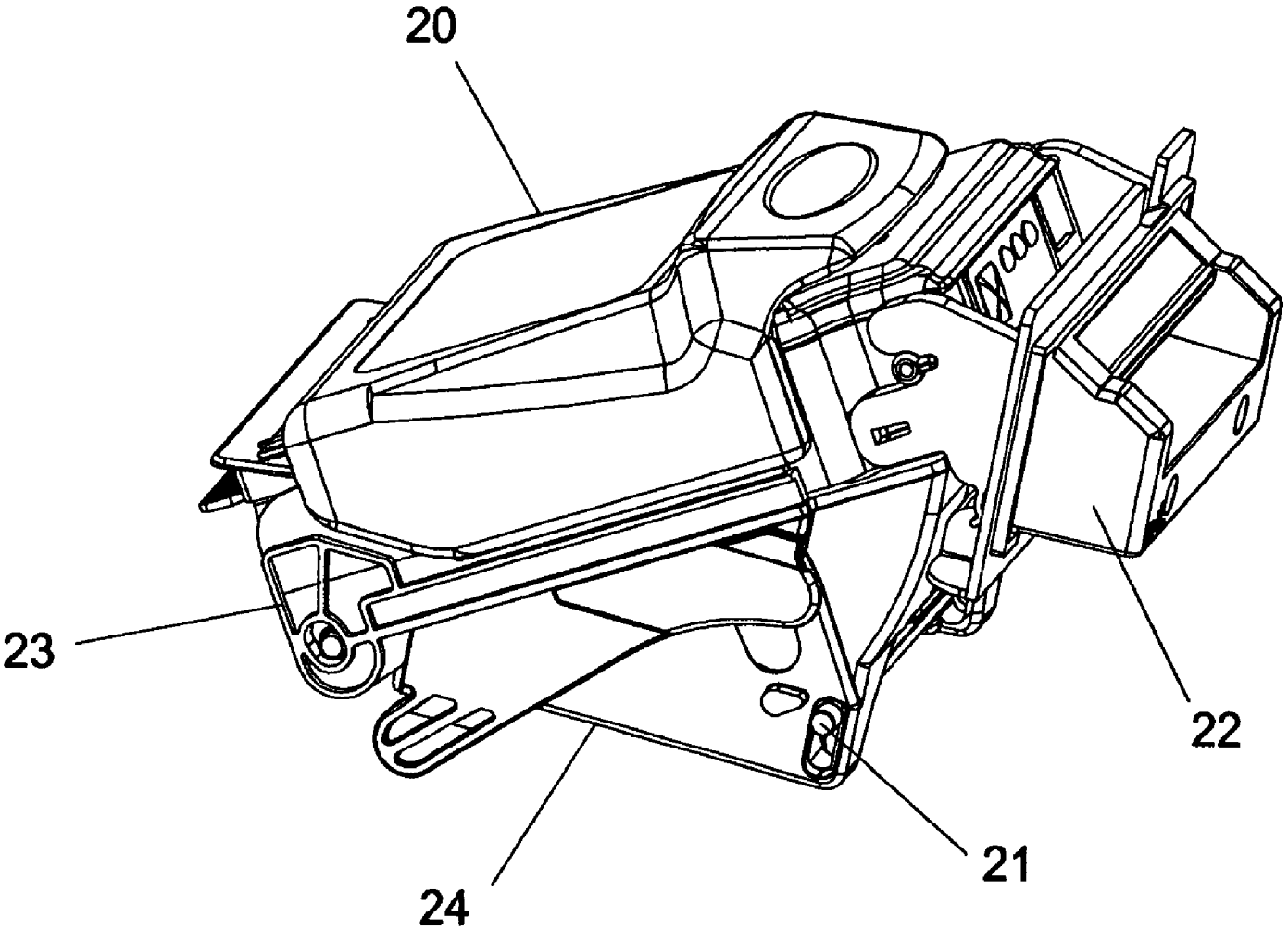
FIG. 5 is an elevated side view of a bill acceptor according to one embodiment of the present invention.

FIG. 5 shows the bill acceptor 20 according to an exemplary embodiment of the present invention. In the preferred embodiment, the bill acceptor 20 (which may also be referred to here as a bill reader or a bill reader validator) may be any bill acceptor known in the industry by those skilled in the art. For example, the bill acceptor 20 may be a bill reader/validator (a "BRV") made by Mars Electronics, Inc. The bill acceptor 20 has a snout 22 for receiving money, electronics (not shown) for validating or processing the currency being deposited, a back end 23 for depositing the currency into the cash cassette 10, and a bottom 24. In the shown embodiment, the bill acceptor 20 has a bar 21 located near and below the snout 22 across the face of the bill acceptor 20. The bar 21 fits within a pair of grooves 360 and 358 (FIG. 14A) on the extending arms 32 and 34 of the bill reader chassis 350.

Figure 8:
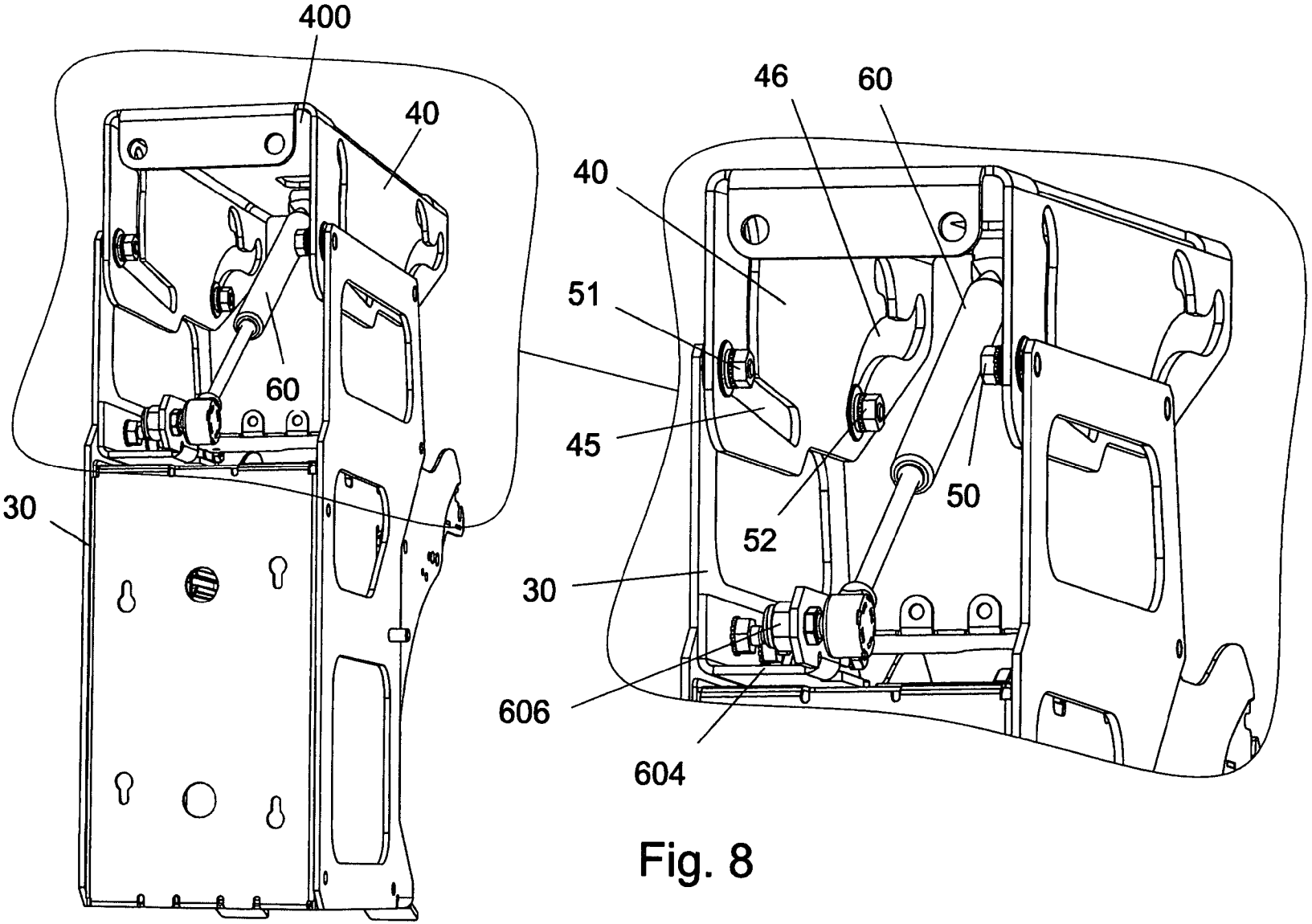
FIG. 8 is a cross-sectional rear view of a drop safe, showing the rear view of a carriage and a gas spring according to one embodiment of the present invention.

Lastly, referring to FIGS. 8 and 2, according to a preferred embodiment of the present invention, the motion of the safe door 2 (and thus the cash cassette 10 and the bill acceptor 20) is assisted or dampened by means of a gas spring 60. The gas spring 60 is mounted between the carriage assembly 30 and the inner surface of the top 400 of the rail plate 40. The gas spring 60 may be any commercially available gas spring, such as, for example a gas spring available from H.A. GUDEN CO. under the model number GGS43-0XX-K, where XX designates pounds of force. A top mounting point 61 of the gas spring 60 (seen in FIGS. 2 and 7A-B), according to the exemplary embodiment, has a gas spring attachment flange 600 folded at approximately a right angle to the top 400 of the guide rail plate 40 (FIG. 7B). The gas spring attachment flange 600 has an opening 602 for receiving a bolt or a fastener attaching the gas spring 60. Accordingly, the top end of the gas spring 60 is mounted to the flange 600 at point 61 by screws or bolts placed through the opening 602. The gas spring 40 allows the safe door 2 to be opened (and closed) in a gradual and controlled manner. In this manner, the carriage assembly 30 is counter-balanced by the progressively suspended gas spring 60 for easier operation of the safe door 2.

Assembly of the components described above, according to a preferred embodiment of the invention, requires, among other things: (1) attaching the door 2 to the housing 1' and coupling the door 2 to the carriage assembly 30, (2) assembling the mounting plate 40 and attaching it to the top 100 of the safe housing 1', (3) mounting the carriage assembly 30 onto the mounting plate 40 via guide tracks 42, (4) placing the cash cassette 10 within the carriage assembly 30, and (5) placing the bill acceptor 20 on the bill reader chassis 350. Each one of these steps will be now described in more detail.

As shown in FIGS. 3 and 11, in a preferred embodiment of the present invention, the safe door 2 is pivotally attached to the front 116 of the housing's bottom 102 by means of two door hinges 4 and 6. The first (right) door hinge 4 (shown in FIG. 2) is a hinge comprising two cylindrically shaped parts 140 and 142 joined by a pin. The cylindrically shaped part 140 is fixedly attached, or welded, to the housing 1' while the cylindrically shaped part 142 is attached to the door 2 and can pivot. A second (left) door hinge 6 is reciprocally comprised of two cylindrically shaped parts joined by a pin, the cylindrical part 138 of this hinge is attached to the housing 1' (FIG. 11). The door hinges 4 and 6 are heavy duty hinges, which are first assembled by pivotally joining their respective cylindrically shaped parts and then welding the respective cylindrically shaped parts onto the door and the housing. That is, the door hinge 4 is first assembled by pivotally joining parts 140 and 142, and the part 140 is welded onto the bottom of the housing 1' while the part 142 is welded to the bottom of the safe door 2. The door hinge 6 is assembled and molded in a similar manner.

In a preferred embodiment, the safe door 2 opens by pivoting outward and downward about a pivot axis of the hinge 13 shown in FIG. 1. However, in other embodiments, the safe door 2 and its hinges may be located higher on the front of the housing 1'. In this case, the housing would have a front side, or the front flange 120 may extend further up. In yet another embodiment, the safe door 2 may open by being rotated up and outward about a pivot point located near the top of the front of the housing 1', at the flange 122, for example. This location of the door may be advantageous for users that need to place the drop safe high up. Configurations of various mounting brackets and the guide rail plate 40, as well as the guide rails 42 would have to be adjusted accordingly (e.g. the carriage assembly could be pulled out and down).

Referring now again to FIG. 2, the safe door 2 is coupled to the carriage assembly 30 via a pair of door drag links 36 and 37 (which may also be called door arms or bars), preferably made of metal bars, so that the carriage assembly 30 is pulled up and out toward the opening 108 of the housing 1' as the door 2 moves from the closed to the open position. On the ends further away from the door 2, the door drag links 36 and 37 are pivotally attached to the carriage assembly 30. More specifically, the door drag link 36 is pivotally connected by a bolt through the hole 314 on the right side 308 of the carriage assembly 30. The door drag link 37 is pivotally connected by a bolt through the hole 315 on the left side 306 of the carriage assembly 30 (see FIG. 6).

On the other ends, closest to the door 2, the door drag links 36 and 37 are pivotally attached to the door 2. (FIGS. 2, 12A, 12B) More precisely, the door drag link 36 is pivotally attached to the door drag link bracket 230 by a bolt through the hole 222, and the drag link bracket 37 is pivotally attached to the door drag link bracket 232 by a bolt through the hole 224, the holes 222 and 224 being located on the door drag link brackets 230, 232 mounted to the inner surface 200 of the door 2. In an alternative embodiment, the door drag links 36 and 37 may be pivotally attached to one larger mounting bracket attached to the inside of the door 2. When the door 2 is in the closed position (shown in FIG. 9A), the flange 122 fits between the top 206 flange of the door 2 and the ledge 226.

To assemble the mounting plate 40 the first and second side sections 402 and 404 are mounted to the middle section 400 of the carriage plate 40 by means of four brackets 406, 408, 410, and 412 at the corners of the middle section 400 (shown in FIG. 15). Alternatively, the carriage plate 40 may have two separate sections, each section being mounted directly to the top inner surface of the housing 1' at right angles and support the carriage assembly 30 via the guide tracks 42, one guide track located in each of the two sections of the carriage plate 40. Alternatively, the carriage plate may be a single internal piece with side sections.

Referring more specifically to FIG. 15B, the back of the rail plate 40 is supported horizontally by two bullet nose dowels 74 mounted at right angles to a downward extending wall of the bullet nose alignment bracket 63. Vertically, the rail plate 40 is supported by a stud 72 which fits through the key slot 62 (FIG. 2) and is secured with a fastener 70, which may be a knurled nut, a hex nut, a wing nut, a fastener, or the like. In FIG. 15B, the fastener 72 a nut and a washer which are used to fasten the carriage plate 40 to the forward stud 72 on the top 100 inner surface of the housing 1' through the key slot 62 (see FIG. 2)

Mounted to the carriage plate 40 is the carriage assembly 30 (FIG. 6). In a preferred embodiment, the carriage assembly 30 is indirectly mounted to the top 100 surface of the housing 1' of the drop safe 1 via the carriage rail plate 40 and guide tracks 42, such that the carriage assembly 30 is supported by the top inner surface of the housing 1'. The four support members 49, 50, 51, and 52 (seen in FIG. 6), are slideably mounted in the guide tracks 42, thereby mounting the carriage assembly 30 on to the carriage plate 40. In particular, the four support members 50, 51, 49 and 52 are attached to the carriage assembly 30 and are slideably mounted on the left-aft 48, right-aft 45, left-front 47 and right-front 46 tracks, respectively. As described above, the tracks 42 are located in the two side sections 402 and 404 of the carriage plate 40, which support the carriage assembly 30. The two side sections 402 and 404 are attached to the middle section 400, which is in turn attached to the top 100 inner surface of the housing 1'. In this manner, the carriage assembly 30 is supported by the housing 1' via the carriage plate 40.

To place the cash cassette 10 within the carriage assembly 30, the operator slides the cash cassette 10 into the carriage assembly 30 from the open end at the front 310 of the carriage assembly 30. In a preferred embodiment, the carriage assembly 30 contains side guide grooves which fit into reciprocal guide tracks 318 and 320 which are molded and attached onto the sides of the bill reader chassis 350. The cash cassette 10 is then slid back, toward the back 304 of the carriage assembly 30, and comes to rest when it is fully inserted into the carriage assembly 30. The top of the cash cassette 10 is supported by the guide tracks 318 and 320 and is suspended within the body of the carriage assembly 30. The cash cassette 10 may be removed, by simply being slid out of the carriage assembly 30 along the guide tracks 318 and 320.

Alternatively, in other embodiments of the present invention, the cash cassette 10 may fit within the carriage assembly 30 in a variety of ways. For example, the cash cassette 10 may rest on the floor 302 of the carriage assembly 30. In further embodiments of the invention, the floor 302 of the carriage assembly 30 may be made of or covered by a slippery material, or may contain rollers to facilitate easier movement of the cash cassette 10 in and out. In a further embodiment, the carriage assembly 30 may have a guide on the bottom of the carriage assembly 30 which guides the cash cassette 10 as it is being placed in the carriage assembly 30.

The bill acceptor 20, as shown in FIG. 5 and 16, is mounted onto the bill reader chassis 350 by being simply placed into the bill reader chassis 350, so that the end 23 of the bill acceptor 20 rests over the slot 36 in the cash cassette 10, and the bar 21 of the bill acceptor 20 fits in the grooves 358 and 360 on the extending arms 32 and 34 of the bill reader chassis 350. The back of the bill acceptor 20 has exposed circuit board contacts which engage contacts of the electronics 35 (FIG. 4) while simultaneously providing alignment for the bill path between the bill acceptor 20 and the cash cassette 10. The bottom 24 of the bill acceptor 20 rests on the metal plate 33 of the bill reader chassis 350.

When the bill acceptor 20 is mounted on the bill acceptor chassis 350, and when the safe door 2 is in the upright and closed position (FIG. 9A), the snout 22 fits approximately flush against the slot 5 in the safe door 2 and the bill acceptor 20 is positioned in precise read/write proximity of RFID transceiver electronics for optimal RFID data transfer to the cash cassette 10. In this position, the back end 23 of the bill acceptor 20 is juxtaposed to a money-receiving slot 36 in the cash cassette 10, thereby minimizing the distance that bills must travel after being deposited through the slot 5 before being received in the cash cassette 10. Minimizing the travel distance of cash currency is advantageous because it minimizes the risk of currency being damaged, torn or jammed within the safe.

Mounting of the gas spring 60 is best seen in FIGS. 6 and 8. As mentioned previously, the top of the gas spring 60 is pivotally attached to a flange 61 of the top 400 of the carriage plate 40. The gas spring may be attached by screws and bolts, or, alternatively, in any other manner allowing the gas spring 60 to pivot with the movement of the carriage assembly 30. At the lower end, the gas spring 60 is pivotally attached to the carriage assembly 30 via screws and bolts 606 attached to a flange 604 extending from one of the sides of the carriage assembly 30. The gas spring 10 has at both ends a plastic fitting (a spherical socket), and the spherical sockets is snapped onto a ball stud (a ball and socket joint—or Heim joint). The ball stud attaches to the flange 604 and the flange 602.

After the drop safe according to the present invention is assembled, operation of the safe may be understood by reference to FIGS. 9A-9F. While the safe door 2 is in the closed position (FIG. 9A), a user may insert bill currency into the slot 5, which then travels through the bill acceptor 20 and is deposited into the cash cassette 10. The currency is securely stored in the cash cassette 10 within the interior of the drop safe 1 until the safe door 2 is opened and the cash cassette 10 is removed. A safe operator, thusly, may at some point require to remove the cash cassette 10 to collect the currency, remove the bill acceptor 20, or to service the interior components of the safe 1. In order to facilitate this, the carriage assembly 30 moves along the guide tracks 42 up and out toward the opening of the safe 108 as the door 2 is being opened.

The progressive movement of the carriage assembly 30 as the door is being opened is shown in FIGS. 9A-9F. The motion of the carriage assembly 30 is possible because the safe door 2 is coupled to the carriage assembly 30, which houses the cash cassette 10, via a pair of door drag links 36 and 37 that pull the carriage assembly 30 and the safe components housed within it toward and, at least partially, through the opening being formed by the opening door 2. The motion of the carriage assembly 30 is defined by the shape of the tracks 42 (shown in FIG. 7A). Thus, the carriage assembly 30 and, accordingly, the bill acceptor 20 and the cash cassette 10, are moved forward along the guide tracks 42 when the safe door 2 is opened (and are moved backwards in the reverse motion along the tracks 42 when the door is closed). When the door is in the fully opened position (FIG. 9F), the carriage assembly 30 presents the bill acceptor 20 and the cash cassette 10 for removal and/or servicing. As described above, the carriage assembly 30 is constructed so that the cash cassette 10 fits within the housing formed by the space within the carriage assembly 30 and can be removed toward the front of the drop safe 1 by simply being pulled out of the carriage assembly 30 when the door is in the fully opened position.

As was mentioned above, the guide tracks 42 are specifically patterned to dictate the desired motion of the carriage assembly 30. In the exemplary embodiment of the present invention, the aft (rear) tracks 48 and 45 guide the movement of the rear of the carriage assembly 30 forward and downward. The front tracks 47 and 46 guide the movement of the front of the carriage assembly 30 forward and upward.

Figure 9F:
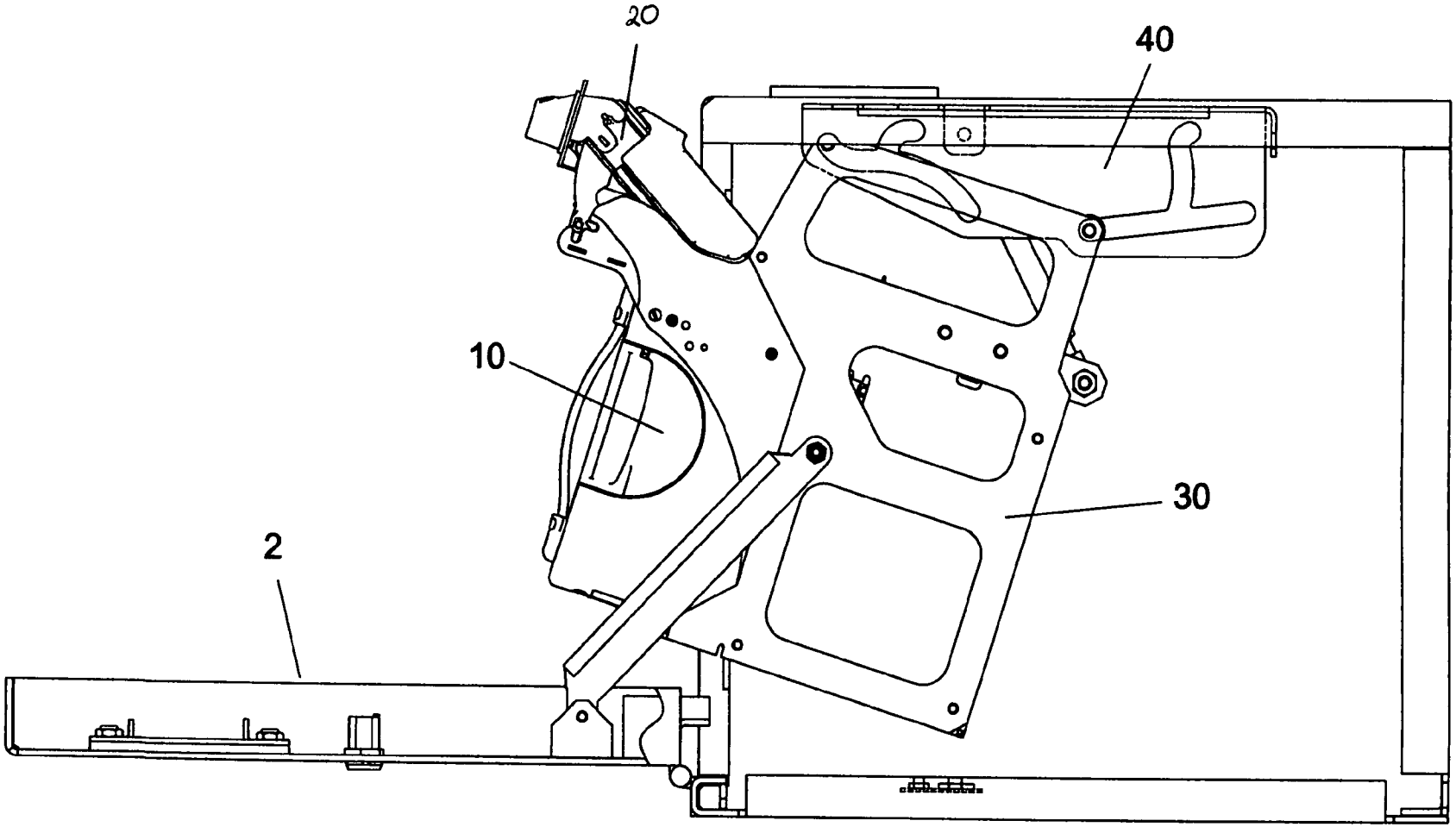

FIGS. 9A through 9F show the progressive motion of the carriage assembly 30 together with the bill acceptor 20 and the cash cassette 10 as the safe door 2 is being opened (i.e. moves from the closed position in FIG. 9A to the open position in FIG. 9F).

Referring now to FIG. 9A, the safe door 2 is in an upright closed position. The cash cassette 10 is resting within the carriage assembly 30. The corresponding support members 49, 50, 51 and 52 (FIGS. 6 and 8) are located in or near the aft sides of the corresponding front and aft tracks. In this position, the carriage assembly 30, and the cash cassette housed by it, are recessed away from the door 2, providing space for additional components to enhance safe's security, such as, for example, a door locking mechanism and/or additional bill acceptor bezel armor. The motion of the carriage assembly 30, which will be discussed below, also provides space for such additional security components.

FIGS. 9B-9E show the drop safe 2 according to the preferred embodiment of the invention where the safe door 2 is opened to 18°, 36°, 54° and 72°, respectively. As the safe door 2 is being opened, it pulls the pair of door drag links 36 and 37 forward, which in turn pull the carriage assembly 30 toward the opening 108 in the housing 1'. The forward and upward motion of the carriage assembly 30 is guided by the movement of the support members 49, 50, 51 and 52 within the guide tracks 42. As the carriage assembly 30 is pulled by the pair of door drag links 36 and 37, the support members 49, 50, 51 and 52 roll or slide within the guide tracks 42, thereby moving the carriage assembly 30 along a preset trajectory. The cash cassette 10 and the bill acceptor 20, mounted to or resting within the carriage assembly 30, move accordingly.

FIG. 9F shows the drop safe 1, according to the preferred embodiment of the invention, with the safe door 2 in the fully opened position, presenting the bill acceptor 20 and the cash cassette 10 for removal and/or servicing or repair. In this position, the cash cassette 10 (which is a front loaded cash cassette) is moved forward, partially out of the housing 1' and tilted up for easier removal. In an embodiment of the present invention, the cash cassette 10 is tilted up approximately 16 to 18 degrees from the horizontal plane. In other embodiments, the cash cassette can be moved forward, further out of the housing 1', or tilted to any other angle (if any at all) for ease of removal from the drop safe 1

As can also be seen from FIG. 9F, the snout 22 of the bill acceptor 20 is moved up and out from the opening 108 of the outside front of the safe housing 1'. In this position the bill acceptor 20, as well as all sub-assemblies of the bill acceptor 20 (not shown) can be removed and/or replaced manually, without the use of tools, by simply being lifted and/or pulled out of the bill reader chassis 350. Positioning of the bill acceptor 20 on the bill reader chassis 350 allows for tool-less disassembly of the bill acceptor 20 into subcomponents for service, thereby allowing for quick restoration of the drop safe 1 for service. In an alternative embodiment, the hood (not shown) provides added protection against breakage of the bill acceptor 20 in that it forces a user to remove the bill acceptor 20 from the bill acceptor chassis 350 prior to attempting to disassemble the bill acceptor 20 into subcomponents.

Referring to FIG. 15B, according to an exemplary embodiment of the invention, when the safe door 2 is in the fully opened position (FIG. 9F), the carriage assembly 30 is fully removable. In order to remove the carriage assembly 30 from the drop safe 1, an operator must un-attach the door drag links 36 and 37 from the door drag link brackets 230, 232 of the safe door 2. The operator must then loosen a forwardly located fastener 70 mounted on a stud 72 in the key slot 62. The carriage assembly 30 along with carriage rail plate 40 can then slide forward, the stud 72 sliding within the key hole 62, while the bullet nose alignment bracket 63 remains in place affixed to the housing 100 with the locator pins 64, 65, 66, allowing the carriage assembly 30 and the rail plate 40 to be removed downward and outward through the opening 108. As was described above, the back of the rail plate 40 is supported horizontally by the two bullet nose dowels 74 mounted at a right angles to the downward extending wall of the bullet nose alignment bracket 63, i.e. approximately parallel to the top 100 of the housing 1'. Accordingly, as the rail plate 40 moves forward, the back of the rail plate 40 slides off of the dowels 74, thereby unattaching itself from the bullet nose alignment bracket 63. Thus, this embodiment provides the carriage assembly 30 as a removable subassembly which allows access to vault electronics and simplifies assembly during manufacturing.

Figure 10:
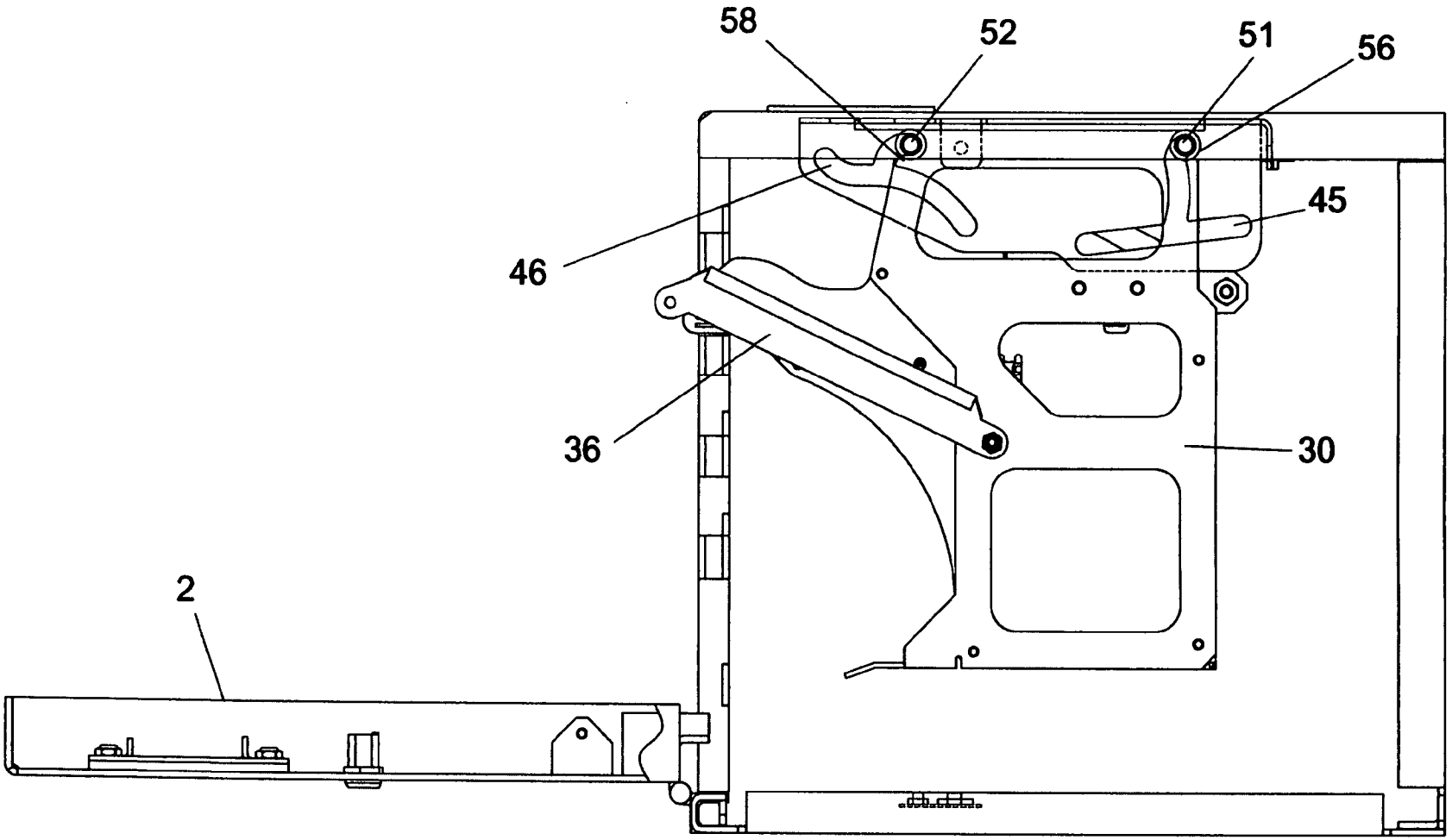
FIG. 10 is a view of a carriage in a stowed upright position, according to one embodiment of the present invention.

In a further embodiment of the present invention, shown in FIG. 10, in addition to removal of the carriage assembly 30, access to the safe's electronics and other interior components may be provided by stowing of the carriage assembly 30 in an upward or stowed position. The carriage assembly 30 can be stowed high by moving the support members 49 and 52 at the front of the carriage assembly 30 up along the upper front tracks 57 and over the detents 58 (which can also be seen in FIG. 7A). The support members 50 and 51 at the back of the carriage assembly 30 up and over detents 56 located on the aft tracks 45 and 48 (also shown in FIG. 7A). In this position, the aft end of the carriage assembly 30 is held in place by the detents 56, while detents 58 and the geometry of the gas spring 60 holds the carriage assembly 30 in place. Stowing of the carriage assembly 30 up high, as well as the removal of the carriage assembly 30 subassembly, allows access to the interior components of the drop safe. This is advantageous because drop safes may have sophisticated electronics and/or components, including, but not limited to a card carriage, a power supply, a processor, an alarm, a modem, etc., which may require servicing or repair in the field. Providing relatively easy access to these components may reduce the time and cost associated with repair or removal of these components.

It will be appreciated by those skilled in the art that the drop safe according to the present invention may be constructed to allow for multiple cash cassettes and bill reader validators to be placed within the carriage assembly 30. In an alternative embodiment, for example, two cash cassettes may be housed within the carriage assembly 30 and two bill acceptors may be placed on the bill reader chassis 350. The housing of the safe 1', as well as the carriage assembly 30, according to this embodiment, are wider, to accommodate the width of the additional cash cassette and bill acceptor. The door 2 of the drop safe 1 has two slots on its front for allowing a user to deposit currency into the two bill acceptors, and thus, the two cash cassettes. This embodiment allows a user to insert currency into the safe at a faster rate, because the user will be able to insert two bills at a time (into the two slots), instead one bill where only one bill acceptor is provided. In this multi-validator embodiment, the slots on the safe door for receiving the corresponding snouts of the bill readers are be positioned respective to the appropriate bezels, their positions depending on the positions, sizes, and operational constrains of safe's components, so that, although it is preferable (for cosmetic purposes) that the slots be symmetric on the safe door, it is not a requirement.

The preceding description has been presented with reference to exemplary embodiments of the invention. Those skilled in the art and technology to which this invention pertains will appreciate that alterations and changes in the described structure may be practiced without meaningfully departing from the principle, spirit, and scope of this invention. Accordingly, the foregoing description should not be read as pertaining only to the precise system described and illustrated in the accompanying drawings, but rather should be read consistent with and as support for the following claims, which are to have their fullest and fairest scope.

What is claimed is:

1. A drop safe comprising a housing, a safe door mounted to the housing to close an opening of the housing, the safe door having a slot to accept deposits, a bill acceptor located in the housing to accept deposits through the slot, a cash cassette located in the housing to store cash received by the bill acceptor, the cash cassette coupled to the safe door and configured to move with movement of the safe door, and wherein as the safe door moves from a closed position to an open position, the cash cassette moves relative to the safe door and through the opening of the housing from a position inside the housing toward a position outside the housing.

2. The drop safe of claim 1 wherein the cash cassette moves outward of the housing and upward as the safe door is moved from the closed position to the open position.

3. The drop safe of claim 1 further comprising a mounting plate attached to the housing, the mounting plate having a guide rail;

a carriage assembly having a support member, the support member movable along the guide rail as the safe door is moved from the closed position to the open position;

wherein the carriage assembly houses the cash cassette.

4. The drop safe of claim 3, wherein the guide rail includes an aft-guide rail and a front-guide rail.

5. The drop safe of claim 1, further comprising an armor plate mounted adjacent the slot along the inside of the safe door, the armor plate having a slot aligned with the slot of the safe door.

6. A drop safe comprising:

a housing;

a safe door mounted to the housing to close an opening of the housing, the safe door having a slot to accept deposits, a bill acceptor located in the housing to accept deposits through the slot, a cash cassette located in the housing to store cash received by the bill acceptor, the cash cassette coupled to the safe door and configured to move with movement of the safe door, a carriage assembly housing the cash cassette; and a gas spring mounted between the carriage assembly and the housing;

wherein as the safe door moves from a closed position to an open position, the carriage assembly moves relative to the safe door from a position inside the housing toward a position outside the housing; and wherein a side of the cash cassette faces the opening in the closed position of the door and wherein the side of the cash cassette faces the opening as the carriage assembly is moved relative to the safe door and toward the opening of the housing.

7. The drop safe of claim 6 further comprising a mounting plate attached to the housing, the mounting plate comprising a left guide rail and a right guide rail;

wherein the carriage assembly includes at least two support members, the at least two support members movable along the left and the right guide rails as the safe door is moved from the closed position to the open position.

8. The drop safe of claim 7, wherein the motion of the carriage assembly is defined by the left guide rail and the right guide rail.

9. The drop safe of claim 7, wherein the carriage assembly moves outward of the housing and upward as the safe door is moved from the closed position to the open position.

10. The drop safe of claim 9, wherein the left guide rail includes an aft-left guide rail and a front-left guide rail, and the right guide rail includes an aft-right guide rail and a front-right guide rail.

11. The drop safe of claim 10, wherein the right-aft track and the left-aft track further include at least two detents, and the carriage assembly is movable to a stowed position by having the at least two support members placed over the at least two detents.

12. The drop safe of claim 3 further comprising a link mounted between the safe door and the carriage assembly such that when the door moves from the closed position to the open position, the link moves the carriage assembly relative to the safe door and toward the opening of the housing.

13. A drop safe comprising:

a housing;

a safe door mounted to the housing to close an opening of the housing, the safe door having a slot to accept deposits;

a bill acceptor located in the housing to accept deposits through the slot;

a cash cassette located in the housing to store cash received by the bill acceptor, the cash cassette coupled to the safe door and configured to move with movement of the safe door;

a carriage assembly housing the cash cassette and having a support member;

a mounting plate attached to the housing, the mounting plate comprising a first guide rail and a second guide rail connected to the first guide rail and extending in a different direction than the first guide rail;

wherein the support member is moveable along the first guide rail between a closed position of the door wherein the cash cassette is in a first position inside the housing and an open position of the door wherein the cash cassette is in a second position moved toward outside of the housing through the opening of the housing with opening movement of the door; and wherein the support member is moveable along the second guide rail to move the cash cassette from a position between the first position and second position to a third position in the housing different from the first position and the second position.

14. The drop safe of claim 13, wherein the cash cassette moves upward relative to the housing and toward the opening when the support member is moved between the first position and the second position.

15. The drop safe of claim 13, wherein the second guide rail is configured to vertically move the support member in the housing.

16. The drop safe of claim 13, wherein the second guide rail comprises a detent to maintain the cash cassette in the third position.

* * * * *